US006879312B2

(12) United States Patent
Ota

(10) Patent No.: US 6,879,312 B2
(45) Date of Patent: Apr. 12, 2005

(54) DISPLAY DRIVER CIRCUIT, ELECTRO-OPTICAL DEVICE, AND DISPLAY DRIVE METHOD

(75) Inventor: Yusuke Ota, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 321 days.

(21) Appl. No.: 10/306,781

(22) Filed: Nov. 27, 2002

(65) Prior Publication Data

US 2003/0122769 A1 Jul. 3, 2003

(30) Foreign Application Priority Data

Dec. 5, 2001 (JP) ..... 2001-371471

(51) Int. Cl.[7] ..... G09G 3/36

(52) U.S. Cl. ..... 345/98; 345/100

(58) Field of Search ..... 345/92, 94, 96, 345/98, 100, 95, 211, 691–693

(56) References Cited

U.S. PATENT DOCUMENTS 5,774,106 A * 6/1998 Nitta et al. ..... 345/98

* cited by examiner

*Primary Examiner*—Richard Hjerpe
*Assistant Examiner*—Ke Xiao
(74) *Attorney, Agent, or Firm*—Hogan & Hartson, LLP

(57) ABSTRACT

In display-OFF-control, in the case where a scan electrode is driven by using voltage levels V3, VC, and MV3 and a signal electrode is driven by using voltage levels V1 and MV, the voltage levels V1 and MV1 are alternately output in a polarity inversion cycle while fixedly outputting the voltage level VC to the scan electrode. The voltage level MV1 is set at VC when V1 is output, and the voltage level MV1 set at VC is fixedly output to the signal electrode. In display-ON-control, the voltage levels MV1 set at VC output to the signal electrode is changed to the original voltage level of MV1 when VC is fixedly output to the scan electrode. After the voltage levels V1 and MV1 are alternately output in the polarity inversion cycle, a pixel is shifted to a normal operation output period.

22 Claims, 25 Drawing Sheets

FIG. 11

RELATION BETWEEN FIELD AND COM WAVEFORM

| | FIELD 1 | FIELD 2 | FIELD 3 | FIELD 4 |
|---|---|---|---|---|
| F1 | H | H | L | L |
| F2 | H | L | H | L |
| LINE 1 | 1 | 1 | -1 | 1 |
| LINE 2 | -1 | 1 | 1 | 1 |
| LINE 3 | 1 | -1 | 1 | 1 |
| LINE 4 (DUMMY LINE) | 1 | 1 | 1 | -1 |

("1" CORRESPONDS TO VOLTAGE LEVEL V3, "-1" CORRESPONDS TO VOLTAGE LEVEL MV3)

FIG. 14A

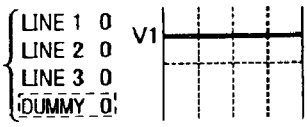

| DISPLAY PATTERN (0=OFF, 1=ON) | SEG WAVEFORM 1f 2f 3f 4f | VOLTAGE APPLIED TO LIQUID CRYSTAL LAYER 1f | 2f | 3f | 4f | EVALUATION VALUE |
|---|---|---|---|---|---|---|
| LINE 1 0 | V1 | LINE 1 Vy−Vx | Vy−Vx | −Vy−Vx | Vy−Vx | $Voff^2$ |
| LINE 2 0 | | LINE 2 −Vy−Vx | Vy−Vx | Vy−Vx | Vy−Vx | $Voff^2$ |
| LINE 3 0 | | LINE 3 Vy−Vx | −Vy−Vx | Vy−Vx | Vy−Vx | $Voff^2$ |
| DUMMY 0 | | | | | | |

FIG. 14B

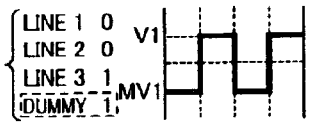

| DISPLAY PATTERN (0=OFF, 1=ON) | SEG WAVEFORM 1f 2f 3f 4f | VOLTAGE APPLIED TO LIQUID CRYSTAL LAYER 1f | 2f | 3f | 4f | EVALUATION VALUE |
|---|---|---|---|---|---|---|
| LINE 1 0 | V1 | LINE 1 Vy+Vx | Vy−Vx | −Vy+Vx | Vy−Vx | $Voff^2$ |
| LINE 2 0 | | LINE 2 −Vy+Vx | Vy−Vx | Vy+Vx | Vy−Vx | $Voff^2$ |
| LINE 3 1 | MV1 | LINE 3 Vy+Vx | −Vy−Vx | Vy+Vx | Vy−Vx | $Von^2$ |
| DUMMY 1 | | | | | | |

FIG. 14C

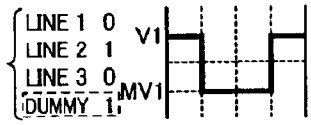

| DISPLAY PATTERN (0=OFF, 1=ON) | SEG WAVEFORM 1f 2f 3f 4f | VOLTAGE APPLIED TO LIQUID CRYSTAL LAYER 1f | 2f | 3f | 4f | EVALUATION VALUE |
|---|---|---|---|---|---|---|
| LINE 1 0 | V1 | LINE 1 Vy−Vx | Vy+Vx | −Vy+Vx | Vy−Vx | $Voff^2$ |
| LINE 2 1 | | LINE 2 −Vy−Vx | Vy+Vx | Vy+Vx | Vy−Vx | $Von^2$ |
| LINE 3 0 | MV1 | LINE 3 Vy−Vx | −Vy+Vx | Vy+Vx | Vy−Vx | $Voff^2$ |
| DUMMY 1 | | | | | | |

FIG. 14D

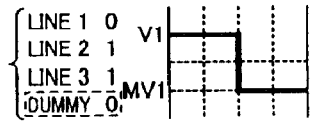

| DISPLAY PATTERN (0=OFF, 1=ON) | SEG WAVEFORM 1f 2f 3f 4f | VOLTAGE APPLIED TO LIQUID CRYSTAL LAYER 1f | 2f | 3f | 4f | EVALUATION VALUE |
|---|---|---|---|---|---|---|
| LINE 1 0 | V1 | LINE 1 Vy−Vx | Vy−Vx | −Vy+Vx | Vy+Vx | $Voff^2$ |
| LINE 2 1 | | LINE 2 −Vy−Vx | Vy−Vx | Vy+Vx | Vy+Vx | $Von^2$ |
| LINE 3 1 | MV1 | LINE 3 Vy−Vx | −Vy−Vx | Vy+Vx | Vy+Vx | $Von^2$ |
| DUMMY 0 | | | | | | |

FIG. 14E

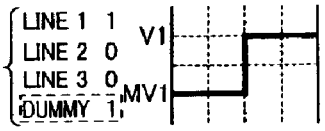

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy+Vx | −Vy−Vx | Vy−Vx | $Von^2$ |
| LINE 2 | −Vy+Vx | Vy+Vx | Vy−Vx | Vy−Vx | $Voff^2$ |
| LINE 3 | Vy+Vx | −Vy+Vx | Vy−Vx | Vy−Vx | $Voff^2$ |

FIG. 14F

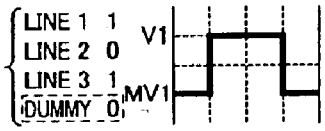

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy−Vx | −Vy−Vx | Vy+Vx | $Von^2$ |
| LINE 2 | −Vy+Vx | Vy−Vx | Vy−Vx | Vy+Vx | $Voff^2$ |
| LINE 3 | Vy+Vx | −Vy−Vx | Vy−Vx | Vy+Vx | $Von^2$ |

FIG. 14G

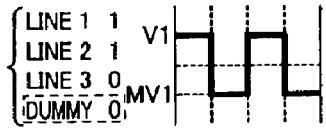

| VOLTAGE APPLIED TO LIQUID CRYSTAL LAYER | 1f | 2f | 3f | 4f | EVALUATION VALUE |
|---|---|---|---|---|---|
| LINE 1 | Vy−Vx | Vy+Vx | −Vy−Vx | Vy+Vx | $Von^2$ |
| LINE 2 | −Vy−Vx | Vy+Vx | Vy−Vx | Vy+Vx | $Von^2$ |
| LINE 3 | Vy−Vx | −Vy+Vx | Vy−Vx | Vy+Vx | $Voff^2$ |

FIG. 14H

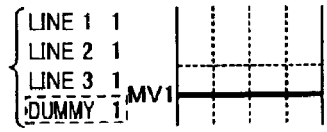

| VOLTAGE APPLIED TO LIQUID CRYSTAL LAYER | 1f | 2f | 3f | 4f | EVALUATION VALUE |
|---|---|---|---|---|---|
| LINE 1 | Vy+Vx | Vy+Vx | −Vy+Vx | Vy+Vx | $Von^2$ |
| LINE 2 | −Vy+Vx | Vy+Vx | Vy+Vx | Vy+Vx | $Von^2$ |
| LINE 3 | Vy+Vx | −Vy+Vx | Vy+Vx | Vy+Vx | $Von^2$ |

FIG. 15

RELATION BETWEEN DISPLAY PATTERN AND DUMMY PATTERN, AND MLS OPERATION RESULTS

400

| DISPLAY PATTERN ("-1" CORRESPONDS TO ON, "1" CORRESPONDS TO OFF) | | | | MLS OPERATION RESULTS ("2" CORRESPONDS TO VOLTAGE LEVEL V1, "-2" CORRESPONDS TO VOLTAGE LEVEL MV1) | | | |
|---|---|---|---|---|---|---|---|
| LINE 1 | LINE 2 | LINE 3 | DUMMY PATTERN | FIELD 1 | FIELD 2 | FIELD 3 | FIELD 4 |
| 1 | 1 | 1 | 1 | 2 | 2 | 2 | 2 |
| 1 | 1 | -1 | -1 | -2 | 2 | -2 | 2 |
| 1 | -1 | 1 | -1 | 2 | -2 | -2 | 2 |
| 1 | -1 | -1 | 1 | 2 | 2 | -2 | -2 |
| -1 | 1 | 1 | -1 | -2 | -2 | 2 | 2 |
| -1 | 1 | -1 | 1 | -2 | 2 | 2 | -2 |
| -1 | -1 | 1 | 1 | 2 | -2 | 2 | -2 |
| -1 | -1 | -1 | -1 | -2 | -2 | -2 | -2 |

410 402 412 404

FIG. 16

DECODE TRUTH TABLE OF 3MLS OPERATION RESULTS

| | D1 | D2 | D3 | OUT (H: VOLTAGE LEVEL V1 / L: VOLTAGE LEVEL MV1) |
|---|---|---|---|---|
| FIELD 1 (f1=「H」) | 0 | 0 | 0 | H |
| | 0 | 0 | 1 | L |
| | 0 | 1 | 0 | H |
| | 0 | 1 | 1 | H |
| | 1 | 0 | 0 | L |
| | 1 | 0 | 1 | L |
| | 1 | 1 | 0 | H |
| | 1 | 1 | 1 | L |
| FIELD 2 (f2=「H」) | 0 | 0 | 0 | H |
| | 0 | 0 | 1 | H |
| | 0 | 1 | 0 | L |
| | 0 | 1 | 1 | H |
| | 1 | 0 | 0 | L |
| | 1 | 0 | 1 | H |
| | 1 | 1 | 0 | L |
| | 1 | 1 | 1 | L |
| FIELD 3 (f3=「H」) | 0 | 0 | 0 | H |
| | 0 | 0 | 1 | L |
| | 0 | 1 | 0 | L |
| | 0 | 1 | 1 | L |
| | 1 | 0 | 0 | H |
| | 1 | 0 | 1 | H |
| | 1 | 1 | 0 | H |
| | 1 | 1 | 1 | L |
| FIELD 4 (f4=「H」) | 0 | 0 | 0 | H |
| | 0 | 0 | 1 | H |
| | 0 | 1 | 0 | H |
| | 0 | 1 | 1 | L |
| | 1 | 0 | 0 | H |
| | 1 | 0 | 1 | L |
| | 1 | 1 | 0 | L |
| | 1 | 1 | 1 | L |

("1" CORRESPONDS TO ON, "0" CORRESPONDS TO OFF)

DISPLAY DRIVER CIRCUIT, ELECTRO-OPTICAL DEVICE, AND DISPLAY DRIVE METHOD

Japanese Patent Application No. 2001-371471 filed on Dec. 5, 2001, is hereby incorporated by reference in its entirety.

BACKGROUND OF THE INVENTION

The present invention relates to a display driver circuit, an electro-optical device, and a display drive method.

In a simple matrix liquid crystal panel, the response time is increased by using a multi-line drive method (multi-line selection: MLS) in which a plurality of scan electrodes are simultaneously selected, whereby an increase in contrast and a decrease in power consumption are realized.

BRIEF SUMMARY OF THE INVENTION

One aspect of the present invention relates to a display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-OFF-control which shifts a pixel specified by one of the scan electrodes and one of the signal electrodes from a display-ON-state to a display-OFF-state, the selector circuit changes the selected voltage from the first voltage to the fixed voltage and outputs the selected voltage, and the multi-valued voltage select circuit fixedly selects the selected voltage after the selected voltage is changed to the fixed voltage by the selector circuit.

Another aspect of the present invention relates to a display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-ON-control which shifts a pixel specified by one of the scan electrodes and one of the signal electrodes from a display-OFF-state to a display-ON-state, the selector circuit changes the selected voltage from the fixed voltage to the first voltage and outputs the selected voltage, and the multi-valued voltage select circuit fixedly selects the selected voltage until the selected voltage is changed to the first voltage by the selector circuit.

Still another aspect of the present invention relates to a display driver circuit which drives a plurality of signal electrodes of a display panel having a plurality of scan electrodes and the signal electrodes by using a multi-line selection which selects three lines of the scan electrodes simultaneously, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects one of the selected voltage and a second voltage as an output voltage based on at least a polarity inversion signal, a signal electrode driver circuit which drives the signal electrodes based on the output voltage, and a power supply circuit which generates the fixed voltage, the first and second voltages, and third and fourth voltages applied to one of the scan electrodes, wherein the selector circuit outputs the fixed voltage when performing display-OFF-control which shifts a pixel specified by one of the scan electrodes and one of the signal electrodes from a display-ON-state to a display-OFF-state, and outputs the first voltage when performing display-ON-control which shifts the pixel from the display-OFF-state to the display-ON-state, wherein the multi-valued voltage select circuit fixedly selects the selected voltage after the selected voltage is changed to the fixed voltage by the selector circuit when performing the display-OFF-control, and fixedly selects the selected voltage until the selected voltage is changed to the first voltage by the selector circuit when performing the display-ON-control, wherein the third and fourth voltages are output to one of the scan electrodes connected with the pixel in a selected period of the pixel, and wherein the fixed voltage is output to one of the scan electrodes connected with the pixel in a nonselected period of the pixel and a period in which one of the display-OFF-control and the display-ON-control of the pixel is performed.

BRIEF DESCRIPTION OF THE SEVERAL VIEWS OF THE DRAWING

FIG. 11 is an explanatory diagram showing the relation between a field and a common waveform;

FIGS. 14A to 14H are explanatory diagrams showing segment waveforms, voltage applied to a liquid crystal layer, and an evaluation value in the case of 3MLS of this embodiment;

FIG. 15 is an explanatory diagram showing the relation between a display pattern and MLS operation results of this embodiment;

FIG. 16 is an explanatory diagram showing an example of a truth table of an MLS decoder of this embodiment;

DETAILED DESCRIPTION OF THE EMBODIMENT

Embodiments of the present invention are described below.

The embodiments described below should not be construed as limiting the scope of the present invention described in the claims. The entire configuration described in the embodiments is not necessarily indispensable for the present invention.

In a liquid crystal panel, display-OFF-control is performed when shifting from a (system) power supply ON state to a power supply OFF state. Display-ON-control is performed when shifting from the power supply OFF state to the power supply ON state. The display-OFF-control is also performed when shifting a portable telephone to a standby state in order to decrease unnecessary power consumption accompanied by liquid crystal display, for example. The display-ON-control is also performed when shifting a portable telephone from a standby state to a full screen display state by using key operations or the like, for example.

Pixels having liquid crystal elements held in intersection regions between signal electrodes and scan electrodes are provided in the liquid crystal panel. Each pixel is specified by one of the signal electrodes and one of the scan electrodes. In the case of turning OFF the liquid crystal display in the display-OFF-control, voltages of the scan electrode and the signal electrode connected with the liquid crystal element are made uniform so that the voltage applied to the liquid crystal element does not exceed a given threshold value. If the pixel is changed from the power supply ON state to the power supply OFF state while allowing a certain voltage to be applied to the liquid crystal element, a DC component is applied to the liquid crystal element. This causes a decrease in display quality, deterioration of the liquid crystal element, and the like.

Figure 21:
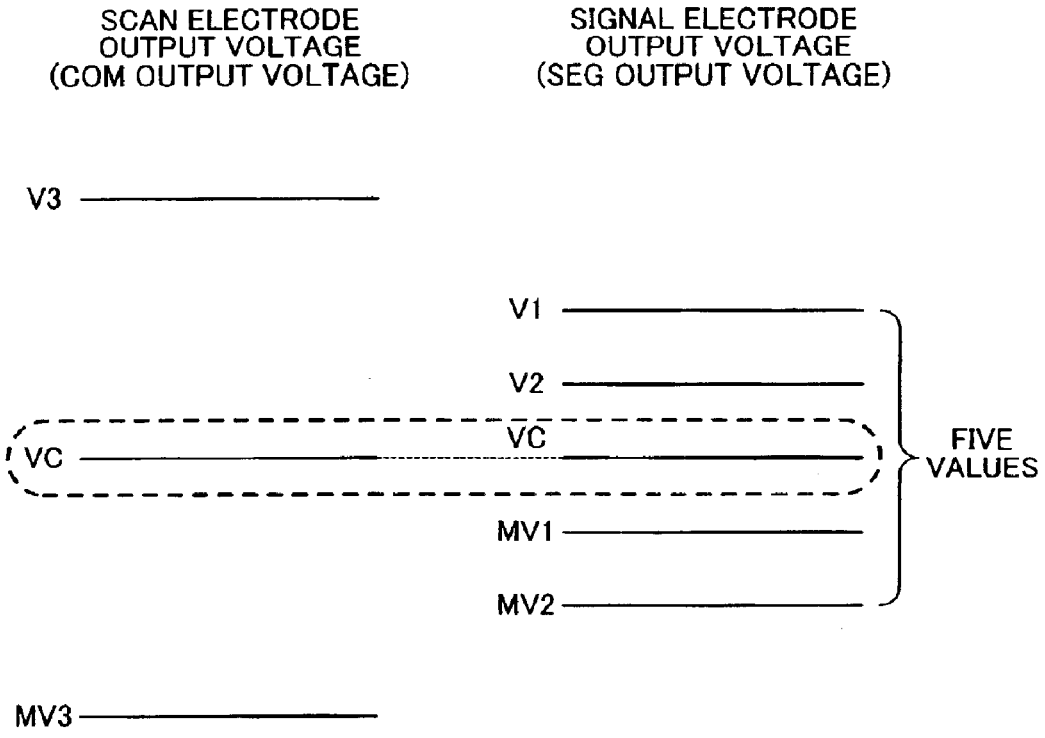
FIG. 21 is an explanatory diagram showing the relation between a drive voltage of the scan electrode and a drive voltage of the signal electrode in 4MLS.

FIG. 21 is a view for describing the relation between a drive voltage of the scan electrode and a drive voltage of the signal electrode in MLS in which four lines are simultaneously selected (4MLS).

In the case where the number of simultaneously selected lines is m (m is a natural number of two or more), the number of voltage levels necessary for driving the signal electrode is generally (m+1). Therefore, if the number of simultaneously selected lines is four, the number of voltage levels is five. In this case, the signal electrode is driven by using five voltage levels (five values) (V2, V1, VC, MV1, and MV2). The voltage levels V2 and MV2 have the same amplitude based on the center voltage level VC. The voltage levels V1 and MV1 have the same amplitude based on the center voltage level VC.

The scan electrode is driven by using two voltage levels (V3 and MV3). The voltage levels V3 and MV3 have the same amplitude based on the center voltage level VC.

Figure 22:
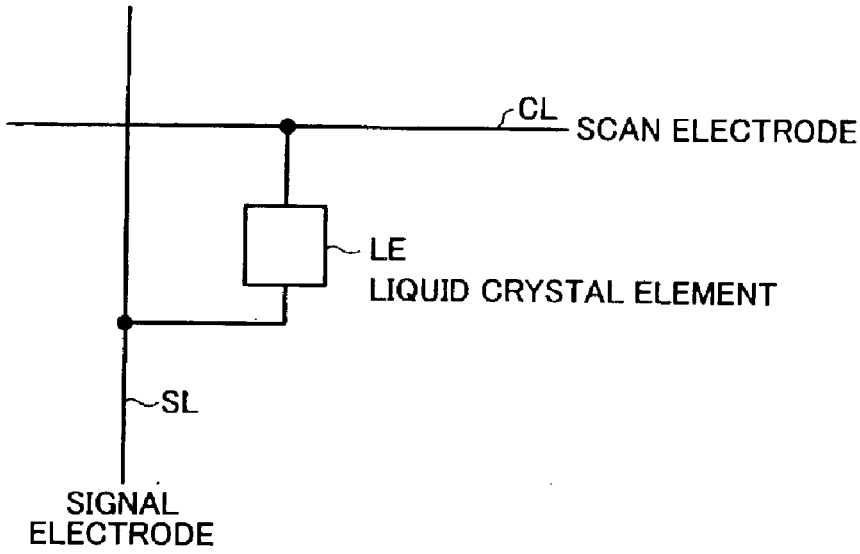
FIG. 22 is a view schematically showing a pixel of a simple matrix liquid crystal panel.

FIG. 22 schematically shows a pixel of a simple matrix liquid crystal panel.

In the pixel of the simple matrix liquid crystal panel, a liquid crystal element LE is connected to a region in which a scan electrode CL intersects a signal electrode SL. Optical characteristics of the liquid crystal element LE vary when the difference between the voltage of the scan electrode CL and the voltage of the signal electrode SL exceeds a given threshold value. Therefore, the liquid crystal element LE is in a display-OFF-state when the difference between the voltage of the scan electrode CL and the voltage of the signal electrode SL is within the given threshold value.

In the case of turning OFF the liquid crystal display in the display-ON-control or the display-OFF-control in 4MLS, the liquid crystal panel can be controlled so that the voltage of the scan electrode and the voltage of the signal electrode are at the center voltage level VC.

However, there may be a case where the voltage level which can be supplied to the scan electrode and the voltage level which can be supplied to the signal electrode cannot be shared depending on the number of simultaneously selected lines in MLS, such as in the case where the number of voltage levels necessary for driving the signal electrode is an even number. Therefore, in the case of controlling the liquid crystal display in an OFF state, it is necessary to provide an additional circuit which generates the center voltage level VC for driving the signal electrode. As a result, transistors or level shifters in an output section for outputting the center voltage level VC are necessary.

According to the following embodiments, a display driver circuit enabling display-ON-control or display-OFF-control without causing an increase in the circuit scale, a display device, and a display drive method can be provided.

One embodiment of the present invention relates to a display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-OFF-control which shifts a pixel specified by one of the scan electrodes and one of the signal electrodes from a display-ON-state to a display-OFF-state, the selector circuit changes the selected voltage from the first voltage to the fixed voltage and outputs the selected voltage, and the multi-valued voltage select circuit fixedly selects the selected voltage after the selected voltage is changed to the fixed voltage by the selector circuit.

The polarity inversion signal refers to a signal for inverting the polarity of voltage applied to the pixel.

In this embodiment, when performing the display-OFF-control by the display driver circuit, the signal electrode is driven by the signal electrode driver circuit based on the voltage output by using the selector circuit and the multi-valued voltage select circuit. The selector circuit changes the output selected voltage from the first voltage to the given fixed voltage supplied to one of the scan electrodes. The multi-valued voltage select circuit fixedly selects the selected voltage after the selector circuit changes the output selected voltage from the first voltage and outputs the output voltage. The signal electrode driver circuit drives the signal electrode based on the output voltage. Therefore, in the case where the pixel can be changed to the display-OFF-state by the difference in voltage between the scan electrode and the signal electrode such as in the case of a simple matrix liquid crystal panel, the scan electrode is set at the fixed voltage and the corresponding signal electrode is driven based on the output voltage set at the fixed voltage by using the above configuration. This eliminates the need to provide a circuit which generates the fixed voltage for merely changing the pixel to the display-OFF-state. Therefore, a circuit which generates the fixed voltage supplied to the scan electrode can be applied, for example. Because of this, the above configuration can be applied for driving a display panel in which the voltage applied to the scan electrode and the voltage applied to the signal electrode cannot be shared.

In the display driver circuit according to this embodiment, when the selected voltage is changed to the fixed voltage by the selector circuit, the multi-valued voltage select circuit may select one of the selected voltage and a second voltage from among a plurality of voltages including the selected voltage as the output voltage, and the selector circuit may change the selected voltage from the first voltage to the fixed voltage, when the second voltage is selected by the multi-valued voltage select circuit.

According to this embodiment, either the selected voltage or the second voltage is selected by the multi-valued voltage select circuit when the voltage is changed by the selector circuit, and the selected voltage is changed to the fixed voltage when the second voltage is selected by the multi-valued voltage select circuit. This prevents a DC component from being applied to the liquid crystal element controlled by the difference in voltage between the scan electrode and the signal electrode, for example. Therefore, deterioration of the liquid crystal element can be prevented while achieving the above-described effects.

Another embodiment of the present invention relates to a display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-ON-control which shifts a pixel specified by one of the scan electrodes and one of the signal electrodes from a display-OFF-state to a display-ON-state, the selector circuit changes the selected voltage from the fixed voltage to the first voltage and outputs the selected voltage, and the multi-valued voltage select circuit fixedly selects the selected voltage until the selected voltage is changed to the first voltage by the selector circuit.

In this embodiment, when performing the display-ON-control by the display driver circuit, the signal electrode is driven by the signal electrode driver circuit based on the voltage output by using the selector circuit and the multi-valued voltage select circuit. The selector circuit changes the output selected voltage from the given fixed voltage supplied to one of the scan electrodes to the first voltage. The multi-valued voltage select circuit fixedly selects the selected voltage until the selector circuit changes the output selected voltage from the given fixed voltage and outputs the output voltage. The signal electrode driver circuit drives the signal electrode based on the output voltage. Therefore, in the case where the pixel can be changed to the display-OFF-state by the difference in voltage between the scan electrode and the signal electrode, such as in the case of a simple matrix liquid crystal panel, the signal electrode is driven fixedly at the selected voltage by using the above configuration in a state in which the corresponding scan electrode is set at the fixed voltage, and the pixel is changed to the display-ON-state by using the first voltage. This eliminates the need to provide a circuit which generates the fixed voltage for merely changing the pixel to the display-ON-state. Therefore, a circuit which generates the fixed voltage supplied to the scan electrode can be applied, for example. Because of this, the above configuration can be applied for driving a display panel in which the voltage applied to the scan electrode and the voltage applied to the signal electrode cannot be shared.

In the display driver circuit according to this embodiment, when the selected voltage is changed to the first voltage by the selector circuit, the multi-valued voltage select circuit may select one of the selected voltage and a second voltage from among a plurality of voltages including the selected voltage as the output voltage, and the selector circuit may change the selected voltage from the first voltage to the fixed voltage, when the second voltage is selected by the multi-valued voltage select circuit.

According to this embodiment, either the selected voltage or the second voltage is selected by the multi-valued voltage select circuit when the voltage is changed by the selector circuit, and the selected voltage is changed to the first voltage when the second voltage is selected. This prevents a DC component from being applied to the liquid crystal element controlled by the difference in voltage between the scan electrode and the signal electrode, for example. Therefore, deterioration of the liquid crystal element can be prevented while achieving the above-described effects.

In the display driver circuit according to this embodiment, the first voltage and the second voltage may have the smallest absolute value of voltage level based on the fixed voltage among the plurality of voltages, the first and the second voltage having inversed polarities.

According to this embodiment, power consumption during driving can be minimized and the size of constituent transistors can be decreased.

In the display driver circuit according to this embodiment, the fixed voltage may be a voltage supplied to one of the scan electrodes in a nonselected period of the pixel.

According to this embodiment, the display-OFF-control or the display-ON-control can be performed without providing an additional circuit by applying the voltage generally used to drive the scan electrode and supplied in the nonselected period of the scan electrode.

Still another embodiment of the present invention relates to a display driver circuit which drives a plurality of signal electrodes of a display panel having a plurality of scan electrodes and the signal electrodes by using a multi-line selection which selects three lines of the scan electrodes simultaneously, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects one of the selected voltage and a second voltage as an output voltage based on at least a polarity inversion signal, a signal electrode driver circuit which drives the signal electrodes based on the output voltage, and a power supply circuit which generates the fixed voltage, the first and second voltages, and third and fourth voltages applied to one of the scan electrodes, wherein the selector circuit outputs the fixed voltage when performing display-OFF-control which shifts a pixel specified by one of the scan electrodes and one of the signal electrodes from a display-ON-state to a display-OFF-state, and outputs the first voltage when performing display-ON-control which shifts the pixel from the display-OFF-state to the display-ON-state, wherein the multi-valued voltage select circuit fixedly selects the selected voltage after the selected voltage is changed to the fixed voltage by the selector circuit when performing the display-OFF-control, and fixedly selects the selected voltage until the selected voltage is changed to the first voltage by the selector circuit when performing the display-ON-control, wherein the third and fourth voltages are output to one of the scan electrodes connected with the pixel in a selected period of the pixel, and wherein the fixed voltage is output to one of the scan electrodes connected with the pixel in a nonselected period of the pixel and a period in which one of the display-OFF-control and the display-ON-control of the pixel is performed.

According to this embodiment, it is unnecessary to provide a circuit which generates a voltage level for merely performing the display-ON-control or the display-OFF-control of each pixel of a simple matrix display panel driven by using the multi-line drive method in which three lines are simultaneously selected. Moreover, the above-described display control can be realized without causing a DC component to be applied to each pixel driven by using the multi-line drive method.

Still further embodiment of the present invention relates to an electro-optical device comprising:

a plurality of scan electrodes, a plurality of signal electrodes, one of the above display driver circuits which drives the signal electrodes, and a scan driver which drives the scan electrodes.

According to this embodiment, it is unnecessary to provide a circuit for generating a common voltage even in the case of an electro-optical device in which the voltage cannot be shared by the display driver circuit and the scan driver. Therefore, a low-cost electro-optical device can be realized by using an extremely simple configuration.

Yet another embodiment of the present invention relates to a display drive method of performing display-OFF-control which shifts a pixel of a display panel having a plurality of scan electrodes and a plurality of signal electrodes from a display-ON-state to a display-OFF-state, the scan electrodes and the signal electrodes intersecting each other, the method comprising:

supplying a voltage selected from among a plurality of voltages to one of the signal electrodes based on grayscale data and a polarity inversion signal, fixing an output voltage to one of the scan electrodes at a given fixed voltage, selecting a first voltage and a second voltage having different polarities from among the plurality of voltages, and alternately supplying the first voltage and the second voltage to one of the signal electrodes based on the polarity inversion signal, setting the first voltage at the fixed voltage when the second voltage is selected based on the polarity inversion signal, and supplying the first voltage set at the fixed voltage to one of the signal electrodes.

In this embodiment, when performing the display-OFF-control, the pixel is shifted from a normal operation output period to a polarity inversion drive period. In the normal operation output period, the voltage selected from a plurality of the voltages based on the grayscale data and the polarity inversion signal is supplied to the signal electrode. In the polarity inversion drive period, the first voltage and the second voltage are alternately supplied to the signal electrode based on the polarity inversion signal. In case of that, the voltage output is fixed to the scan electrode at the given fixed voltage and selected the first voltage and the second voltage having different polarities from a plurality of voltages. The first voltage is set at the fixed voltage in the above period when the second voltage is selected based on the polarity inversion signal, and the first voltage is supplied to the signal electrode. Therefore, in the case where the pixel can be changed to the display-OFF-state by the difference in voltage between the scan electrode and the signal electrode such as in the case of a simple matrix liquid crystal panel, the scan electrode is set at the fixed voltage and the corresponding signal electrode is driven based on the output voltage set at the fixed voltage. In this case, it is unnecessary to generate the fixed voltage merely for changing the pixel to the display-OFF-state. Because of this, this embodiment can be applied for driving a display panel in which the voltage applied to the scan electrode and the voltage applied to the signal electrode cannot be shared.

Yet further embodiment of the present invention relates to a display drive method of performing display-ON-control which shifts a pixel of a display panel having a plurality of scan electrodes and a plurality of signal electrodes from a display-OFF-state to a display-ON-state, the scan electrodes and the signal electrodes intersecting each other, the method comprising:

supplying a first voltage set at a given fixed voltage to one of the signal electrodes, while fixing an output voltage to one of the scan electrodes at the fixed voltage, selecting a second voltage having a polarity different from the polarity of the first voltage, and setting the first voltage at a voltage different from the fixed voltage, alternately supplying the first voltage set at the voltage different from the fixed voltage, and the second voltage to one of the signal electrodes based on a polarity inversion signal, and supplying a voltage selected from among a plurality of voltages based on grayscale data and the polarity inversion signal to one of the signal electrodes.

In this embodiment, when performing the display-ON-control, the pixel is shifted from a fixed voltage supply period to a voltage setting period, in a state in which the voltage output to the scan electrode is set at the given fixed voltage. In the fixed voltage supply period, the first voltage set at the given fixed voltage is supplied to the signal electrode. In the voltage setting period, the first voltage is set at a voltage differing from the fixed voltage. In case of that the second voltage having a polarity differing from the polarity of the first voltage is selected. The first voltage and the second voltage are alternately supplied to the signal electrode based on the polarity inversion signal. The pixel is then shifted to a normal operation output period in which the voltage selected from a plurality of the voltages based on the grayscale data and the polarity inversion signal is supplied to the signal electrode. Therefore, in the case where the pixel can be changed to the display-ON-state by the difference in voltage between the scan electrode and the signal electrode such as in the case of a simple matrix liquid crystal panel, the signal electrode is driven at the selected voltage in a state in which the corresponding scan electrode is set at the fixed voltage, and the pixel is changed to the ON state by using the first voltage. In this case, it is unnecessary to generate the fixed voltage merely for shifting the pixel to the display-ON-state. Because of this, this embodiment can be applied for driving a display panel in which the voltage applied to the scan electrode and the voltage applied to the signal electrode cannot be shared.

In the display drive method according to this embodiment, the fixed voltage may be a voltage supplied to one of the scan electrodes in a nonselected period of the pixel specified by one of the scan electrodes and one of the signal electrodes.

According to this embodiment, the display-OFF-control or the display-ON-control can be performed without complicating the configuration by applying the voltage generally used to drive the scan electrode and supplied in the nonselected period of the scan electrode.

These embodiments of the present invention are described below in detail with reference to the drawings.

1. Electro-Optical Device

Figure 1:
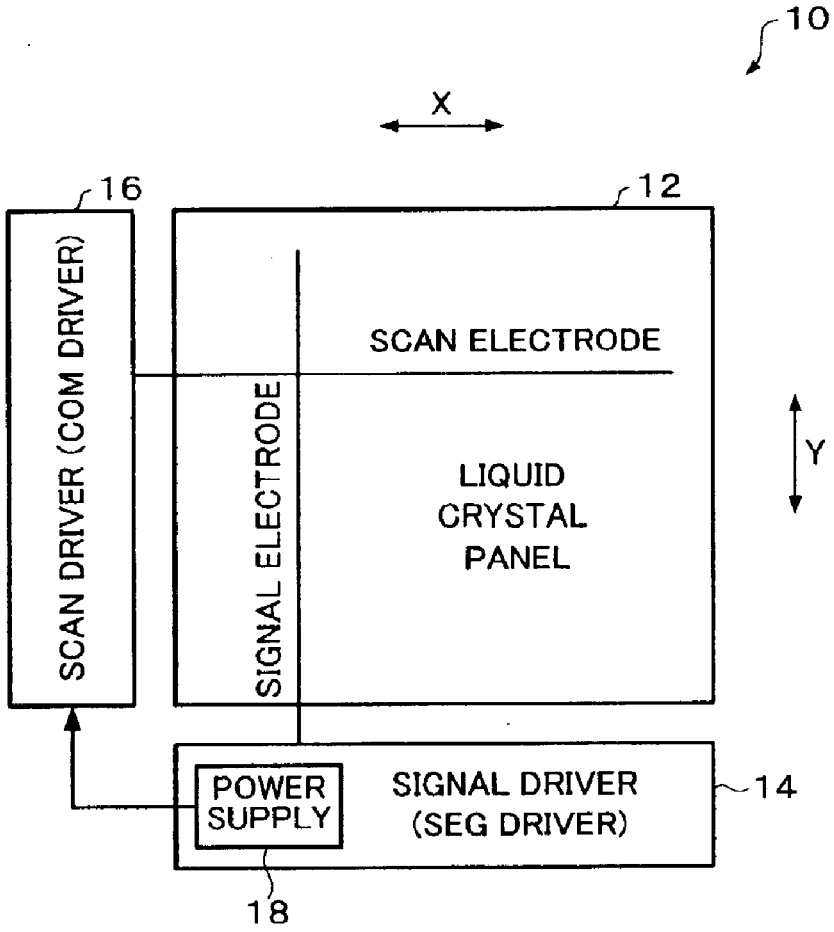
FIG. 1 is a configuration diagram showing an example of a configuration of an electro-optical device of this embodiment.

FIG. 1 shows an example of a configuration of an electro-optical device of this embodiment.

A liquid crystal device (electro-optical device or display device in a broad sense) 10 includes a liquid crystal panel (display panel in a broad sense) 12.

The liquid crystal device 10 may include a signal driver (segment driver, display driver circuit in a broad sense) 14 which drives the liquid crystal panel 12. The liquid crystal device 10 may include a scan driver (common driver) 16 which drives the liquid crystal panel 12.

Pixels having liquid crystal elements (electro-optical elements in a broad sense) held in intersection regions between signal electrodes and scan electrodes are provided to the liquid crystal panel 12. Each pixel is specified by one of the signal electrodes and the scan electrodes. The pixels have a configuration shown in FIG. 22, for example. There are no specific limitations to the liquid crystal panel 12 insofar as the liquid crystal panel 12 utilizes electro-optical elements such as a liquid crystal of which the optical characteristics are changed by application of voltage. In this case, the liquid crystal panel 12 has a configuration described below. Specifically, a liquid crystal is sealed between a first substrate on which a plurality of signal (segment) electrodes (first electrodes) are formed and a second substrate on which a plurality of scan (common) electrodes (second electrodes) are formed. A plurality of the signal electrodes are arranged on the first substrate in a direction X. A plurality of the scan electrodes are arranged on the second substrate in a direction Y. A plurality of the signal electrodes are driven by the signal driver 14. A plurality of the scan electrodes are driven by the scan driver 16.

The liquid crystal panel 12 may be mounted on a glass substrate, and the signal driver 14 or the scan driver 16, or both, may be provided on the glass substrate.

The signal driver 14 includes a power supply circuit 18. The power supply circuit 18 generates a drive voltage of the signal electrodes driven by the signal driver 14. The power supply circuit 18 generates voltage to be supplied to the scan driver 16. The scan driver 16 drives the scan electrodes by using the voltage supplied from the power supply circuit 18.

The power supply circuit 18 is not necessarily provided in the signal driver 14. The power supply circuit 18 may be provided in the scan driver 16. The power supply circuit 18 may be provided outside the liquid crystal device 10.

The liquid crystal panel 12 is driven by using a multi-line drive method (multi-line selection: MLS) in which a plurality of the scan electrodes are simultaneously selected. In the case where the number of simultaneously selected scan electrodes is m (m is a natural number; m=4, for example), the scan driver 16 scans the scan electrodes in units of m lines. The signal driver outputs voltage having a segment waveform (signal electrode drive waveform, SEG waveform) based on a display pattern in units of n lines (n is a natural number; n=4 when m=4, for example) to the signal electrode. The segment waveform is specified by MLS operation results for the display patterns by using orthogonal functions corresponding to the scan pattern of the scan electrodes.

In the case of MLS in which m lines are simultaneously selected (m-line MLS), the number of voltage levels necessary for driving the scan electrodes is generally three, and the number of voltage levels necessary for driving the signal electrode is (m+1). In this case, three values of voltage levels necessary for driving the scan electrodes and (m+1) values of voltage levels necessary for driving the signal electrode are generated by the power supply circuit and respectively supplied to the scan driver and the signal driver. In this embodiment, in order to decrease the number of voltage levels in the signal driver as much as possible, MLS in which three lines are simultaneously selected (3MLS) is driven by using two values of voltage levels and contrast equal to MLS in which four lines are simultaneously selected (4MLS) is realized by using a concept of a virtual electrode. In more detail, the signal driver in this embodiment outputs operation results for three lines obtained by the same operations as in 4MLS on the display pattern for three lines corresponding to the scan electrodes and a dummy display pattern (dummy pattern) corresponding to the display pattern by using the scan pattern of the simultaneously selected three scan electrodes and a dummy scan pattern of the virtual electrode corresponding to the scan pattern to the signal electrode.

Figure 2:
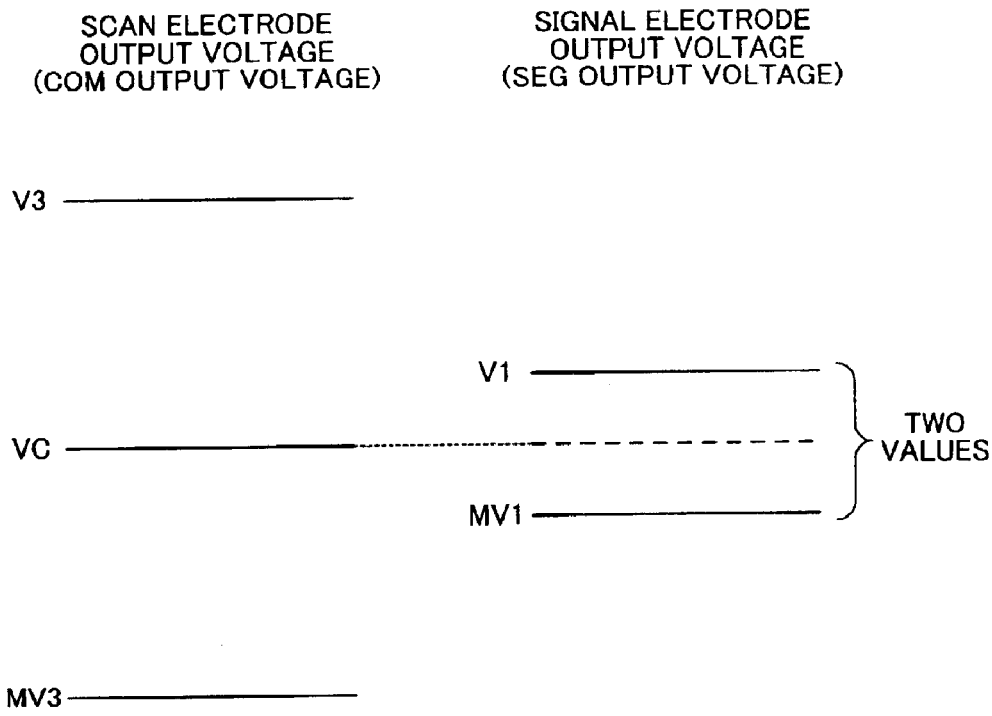
FIG. 2 is an explanatory diagram showing the relation between a drive voltage of a scan electrode and a drive voltage of a signal electrode in 3MLS of this embodiment.

FIG. 2 is a view for describing the relation between the drive voltage of the scan electrode and the drive voltage of the signal electrode in 3MLS in this embodiment.

The scan electrodes are driven by using voltage levels V3 and MV3 having the same amplitude based on a center voltage level VC. The signal electrode is driven by using two values of voltage levels V1 and MV1.

According to 3MLS in this embodiment, since the number of voltage levels can be decreased to two, the configuration and drive control can be simplified. However, the voltage level which can be applied to the signal electrode and the voltage level which can be applied to the scan electrode cannot be shared between the signal driver and the scan driver. Specifically, the signal driver 14 which drives the signal electrode has a configuration in which the center voltage level VC shared between the signal driver 14 and the scan driver 16 which drives the scan electrodes is unnecessary. Therefore, in the case of turning OFF the liquid crystal display by decreasing voltage applied to the liquid crystal element as shown in FIG. 22, the voltages of the signal electrode and the scan electrode connected with the liquid crystal element cannot be made uniform. Therefore, when realizing a conventional method, a driver (transistor) for generating the center voltage level VC and a circuit such as a level shifter are necessary in order to merely drive the signal electrode. This results in an increase in the circuit scale.

In this embodiment, a voltage level almost equal to the voltage level of the scan electrode is applied to the signal electrode by changing the voltage level V1 or MV1 to the same potential as the center voltage level VC in the power supply circuit which generates the drive voltage output to the signal electrode. This eliminates the need to provide a circuit which generates the center voltage level VC merely for driving the signal electrode to the signal driver.

In the case where polarity inversion drive is performed in order to prevent deterioration of the liquid crystal element or the like, it is necessary to prevent a DC component from being applied to the liquid crystal element due to change to the center voltage level VC. The polarity inversion drive means that the liquid crystal element is driven so that the polarity of the voltage applied to a liquid crystal (pixel in a broad sense) is inverted.

In this embodiment, when one of the voltage levels selected in a polarity inversion cycle is selected, the other voltage level is changed. In the case where the voltage levels V1 and MV1 are alternately selected and output to the signal electrode in the polarity inversion cycle, when the voltage level V1 is selected at a certain polarity inversion timing, the voltage level MV1 is changed to the same potential as the center voltage level VC or the center voltage level VC is changed to the same potential as the voltage level MV1.

Figure 3:
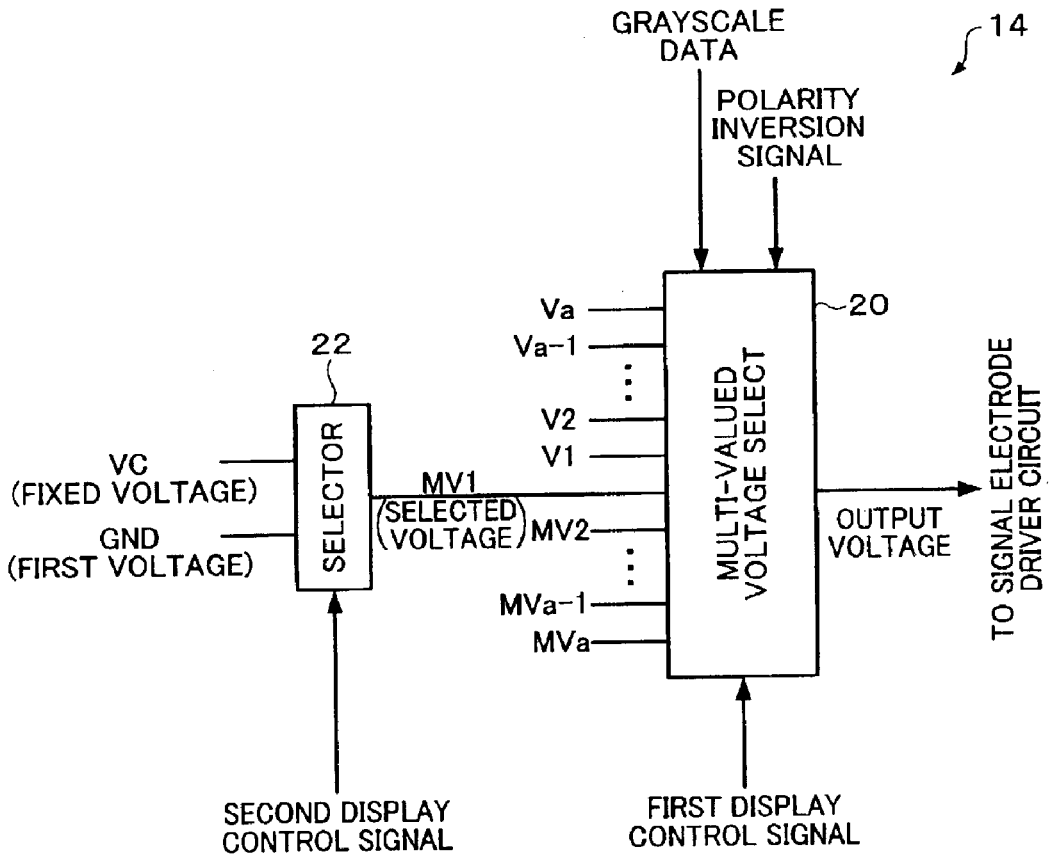
FIG. 3 is a configuration diagram showing a feature of a principle configuration of a signal driver which switches a voltage level of this embodiment.

FIG. 3 shows a feature of a principle configuration of the signal driver which changes the voltage level in this embodiment.

The signal driver 14 includes a multi-valued voltage select circuit 20. The signal driver 14 includes the power supply circuit 18 which includes a selector circuit 22.

A plurality of voltage levels Va (a is a positive natural number), Va-1, . . . , V1, MV1, MV2, . . . , MVa-1, and MVa are input to the multi-valued voltage select circuit 20. Since two voltage levels are used in 3MLS by using the concept of the virtual electrode, only the voltage levels V1 and MV1 (a=1) are input to the multi-valued voltage select circuit 20.

The multi-valued voltage select circuit 20 selects one of a plurality of the voltage levels (Va, Va-1, . . . , V1, MV1, MV2, . . . , MVa-1, and MVa) in response to grayscale data and a polarity inversion signal, and outputs the selected voltage level to a signal electrode driver circuit as an output voltage level in a normal operation output period. The grayscale data corresponds to a display pattern in MLS. The polarity inversion signal specifies an inversion cycle of polarity inversion drive which is performed in each frame or each one or more lines. The signal electrode driver circuit drives the signal electrode based on the output voltage level supplied from the multi-valued voltage select circuit 20.

The multi-valued voltage select circuit 20 may alternately output two voltage levels having different polarities as the output voltage level in synchronization with the polarity inversion signal based on a first display control signal. The two voltage levels having different polarities preferably have the smallest absolute value based on the center voltage level VC.

The selector circuit 22 outputs either the center voltage level VC (given fixed voltage) or a system power supply ground level GND (first voltage) as the voltage level MV1 (selected voltage) based on a second display control signal. The voltage level MV1 is supplied to the multi-valued voltage select circuit 20. The voltage level output from the selector circuit 22 is not limited to the voltage level MV1. The selector circuit 22 may output a voltage level MVz (z is an optional natural number of two or more) as the selected voltage level and supply the voltage level MVz to the multi-valued voltage select circuit 20.

The selected voltage level MV1 is selected at the same potential as the system power supply ground level GND (first voltage) in the selector circuit 22 based on the second display control signal in the normal operation output period, for example. The multi-valued voltage select circuit 20 selects one of a plurality of the voltage levels including the selected voltage level MV1 as the output voltage level based on the grayscale data and the polarity inversion signal, for example, and drives the signal electrode. In the case of performing display-OFF-control for shifting the pixel from a display-ON-state to a display-OFF-state, the center voltage level VC (given fixed voltage) equal to the drive voltage level of the scan electrode is selected in the selector circuit 22 by the second display control signal. In the multi-valued voltage select circuit 20, two voltage levels (voltage levels V1 (second voltage) and MV1, for example) having different polarities with respect to the center voltage level VC are alternately output by the first display control signal in the polarity inversion cycle. After that, one of the voltage levels is set at the center voltage level VC when the other voltage level is selected, for example. The voltage level set at the center voltage level VC is fixedly output from the multi-valued voltage select circuit 20 to the signal electrode by the first display control signal. This allows the voltage applied to the liquid crystal element connected with the signal electrode and the scan electrode to be within a given threshold value. Therefore, the pixel can be shifted to the liquid crystal display-OFF-state without fixing the voltage level at the center voltage level VC by providing a circuit for generating the center voltage level VC merely for driving the signal electrode to the signal driver 14 and without causing a DC component to be applied to the liquid crystal element.

In the case of performing display-ON-control for shifting the pixel from the display-OFF-state to the display-ON-state, the pixel can be shifted to the liquid crystal display-ON-state by the reverse procedure.

In the above described display-OFF-control or display-ON-control, the voltage levels having different polarities may not alternately be output in the polarity inversion cycle. In this case, it is also unnecessary to provide a circuit for generating the center voltage level VC.

A case where the two values of the voltage levels V1 and MV1 are used to drive the signal electrode in 3MLS and the voltage level MV1 is changed to the same potential as the center voltage level VC is described below. However, 3MLS can also be realized even in the case where the voltage level V1 is changed to the same potential as the center voltage level VC.

Figure 4:
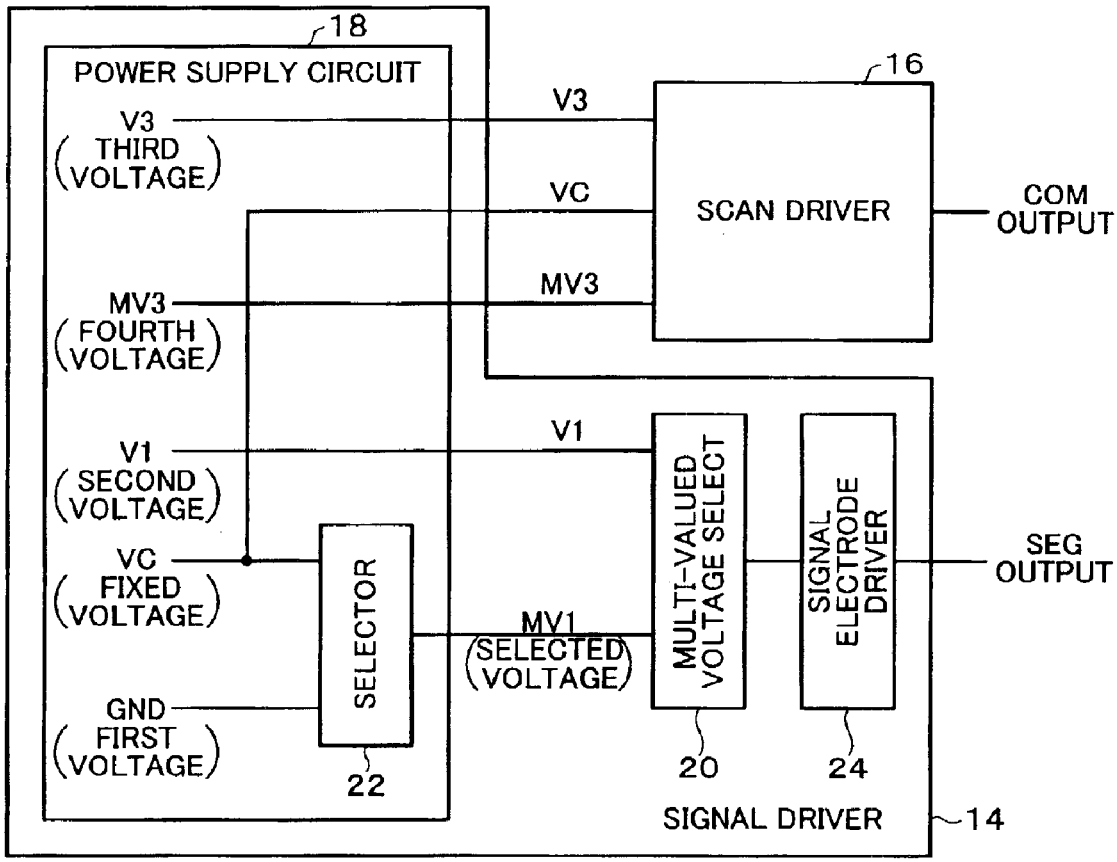
FIG. 4 is an explanatory diagram for describing the relation of supply of various voltage levels of the electro-optical device of this embodiment.

FIG. 4 is an explanatory diagram for describing the relation of supply of various voltage levels in the electro-optical device in this embodiment.

In FIG. 4, the power supply circuit 18 is provided inside the signal driver 14. However, the power supply circuit 18 may be provided outside the signal driver 14.

Two voltage levels (V1 and MV1) are made necessary for driving the signal electrode in 3MLS by employing the concept of the virtual electrode. Therefore, the power supply circuit 18 generates the voltage levels V3 (third voltage), VC (fixed voltage), and MV3 (fourth voltage) necessary for driving the scan electrode, and the voltage levels V1 (second voltage) and MV1 (selected voltage) necessary for driving the signal electrode. Since the principle of generating these voltage levels is known in the art, description of the principle is omitted. In this example, the voltage level MV1 is at the same potential as the system power supply ground level GND (first voltage) in the normal operation output period.

The selector circuit 22 selectively outputs the selected voltage level MV1, which could be at the same potential as either the center voltage level VC or the system power supply ground level GND.

The power supply circuit 18 supplies the voltage levels V3, VC, and MV3 to the scan driver 16. The scan driver 16 outputs the voltage level V3 or MV3 to the scan electrode in a selected period depending on the scan pattern of the simultaneously selected scan electrodes. In a nonselected period, the center voltage level VC is output to the scan electrodes (COM output).

The power supply circuit 18 supplies the voltage levels V1 and MV1 to the multi-valued voltage select circuit 20. The multi-valued voltage select circuit 20 selectively outputs either the voltage level V1 or MV1 as the output voltage. The signal electrode driver circuit 24 drives the signal electrode based on the output voltage (SEG output).

Figure 5:
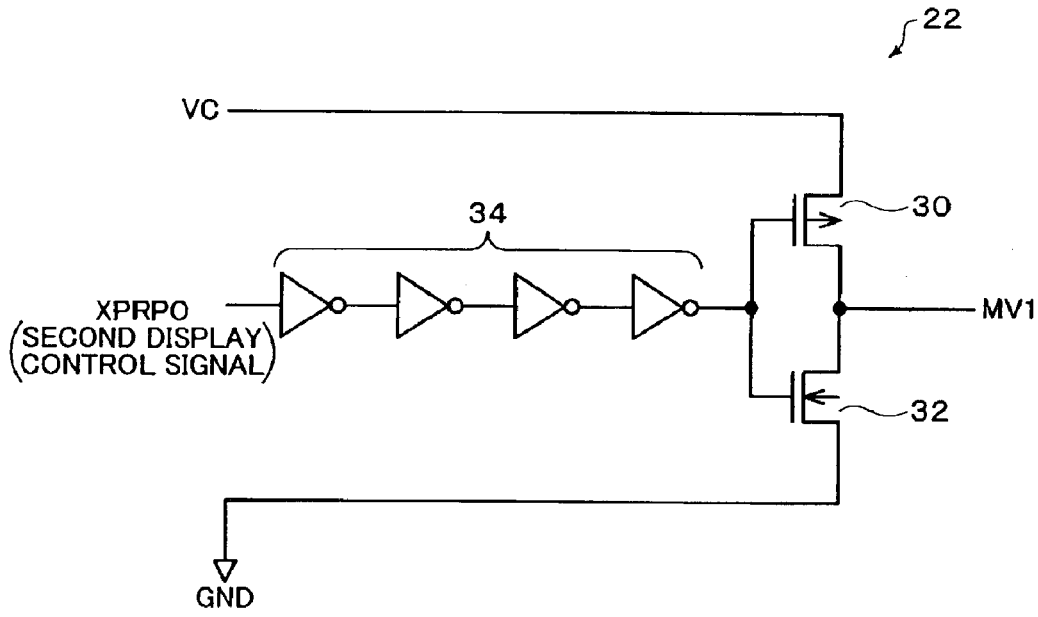
FIG. 5 is a circuit configuration diagram showing an example of a circuit configuration of a selector circuit.

FIG. 5 shows an example of a circuit configuration of the selector circuit 22.

The selector circuit 22 includes a p-type MOS transistor (Trp) 30 and an n-type MOS transistor (Trn) 32. The center voltage level VC is connected with a source terminal of Trp 30. A drain terminal of Trn 32 is connected with a drain terminal of Trp 30. A pre/post display signal XPRPO (second display control signal) is supplied to a gate electrode of Trp 30 through a buffer circuit 34. The system power supply ground level GND is connected with a source terminal of Trn 32. The drain terminal of Trn 32 is connected with the drain terminal of Trp 30. The pre/post display signal XPRPO (second display control signal) is supplied to a gate electrode of Trp 32 through the buffer circuit 34. A voltage level of a node with which the drain terminal of Trp 30 and the drain terminal of Trn 32 are connected becomes the voltage level MV1 as the selected voltage level.

The electro-optical device having such a configuration is capable of realizing a decrease in cost due to a simplified configuration irrespective of the number of voltage levels necessary for drive. In particular, the effect becomes remarkable in the case where voltage shared between the scan electrode and the signal electrode is absent in a simple matrix liquid crystal panel.

Display control performed by using the above configuration is described below in detail.

2. Display Control

Figure 6:
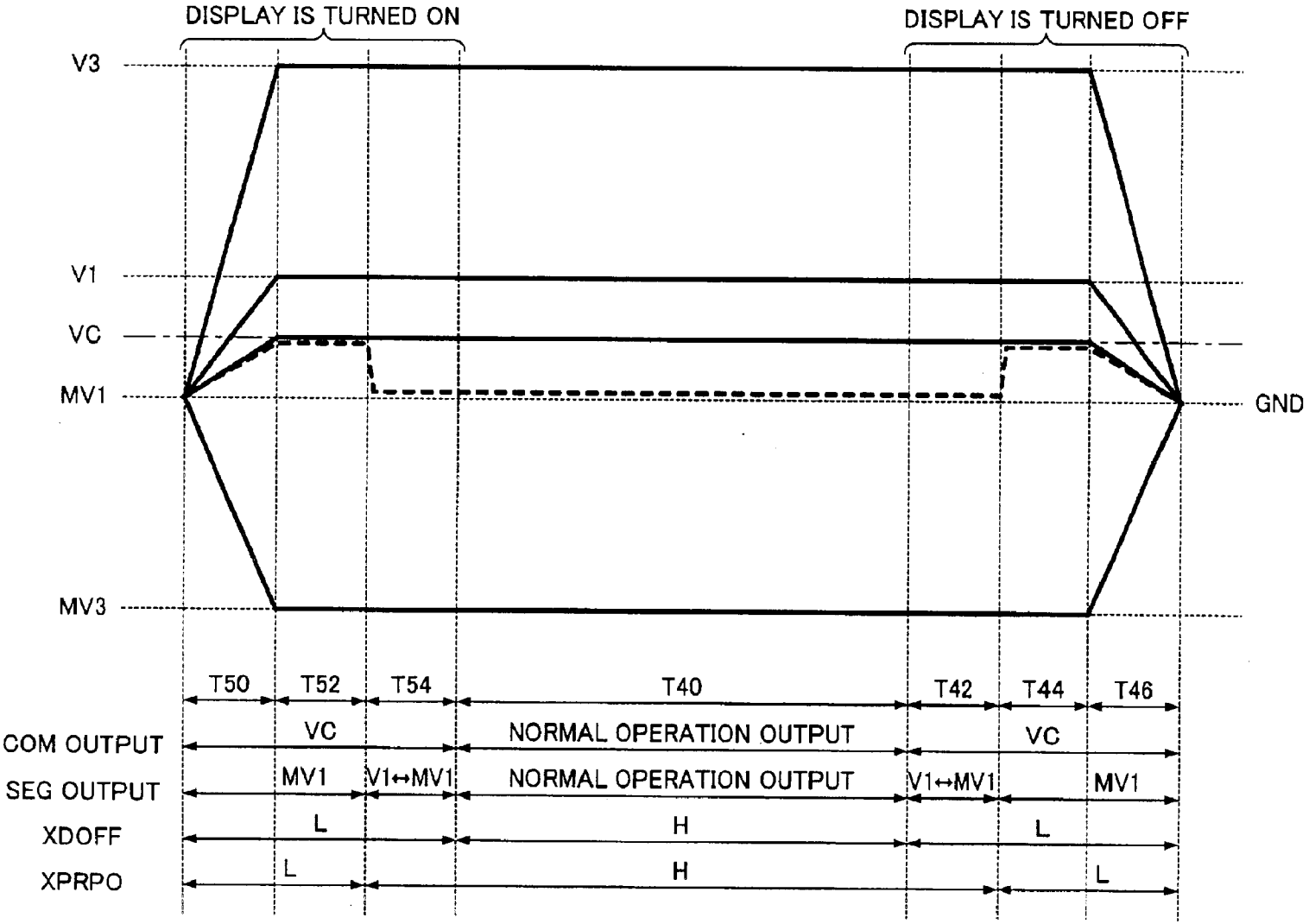
FIG. 6 is an explanatory diagram for describing details of display control performed by a signal driver of this embodiment.

FIG. 6 is a view for describing details of display control performed by the signal driver 14 in this embodiment.

FIG. 6 shows a change of each voltage level in display-OFF-control and a change of each voltage level in display-ON-control. The display-OFF-control is performed when shifting the pixel from the normal operation output period by MLS drive based on the grayscale data to the liquid crystal display-OFF-state. The display-ON-control is performed when shifting the pixel from the liquid crystal display-OFF-state to the normal operation output period by the MLS drive based on the grayscale data.

The following description is given on the assumption that the signal driver 14 performs polarity inversion drive in the polarity inversion cycle based on the polarity inversion signal.

2.1 Display-OFF-Control

The display-OFF-control is described below with reference to FIGS. 6 and 7.

The signal driver 14 supplies the output voltage selected from among a plurality of voltages to the signal electrode based on the grayscale data and the polarity inversion signal in a normal operation output period T40 (display OFF signal XDOFF is "H", pre/post display signal XPRPO is "H") (signal drive step) Specifically, the scan driver 16 outputs the voltage levels V3 and MV3 corresponding to the scan pattern of the simultaneously selected three scan electrodes and the dummy scan pattern corresponding to the scan pattern to the scan electrodes in the selected period of the pixel. The scan driver 16 outputs the center voltage level VC to the scan electrodes in the nonselected period of the pixel. The signal driver 14 outputs either the voltage level V1 or MV1 to the signal electrode in a cycle corresponding to the polarity inversion signal based on the grayscale data corresponding to the scan pattern and the dummy scan pattern.

In a period T42 (display OFF signal XDOFF is "L", pre/post display signal XPRPO is "H"), the voltage level output to the scan electrodes is fixed at the center voltage level VC (fixed voltage), and the voltage levels V1 (second voltage) and MV1 (first voltage) are alternately supplied to the signal electrode based on the polarity inversion signal (polarity inversion drive step). In this example, the number of voltage levels necessary for driving the signal electrode is two. In the case where three or more voltage levels are necessary in other drive methods, the multi-valued voltage select circuit 20 selects the first voltage and the second voltage having the smallest absolute value based on the center voltage level VC (voltage level shared between the scan electrode and the signal electrode in a broad sense) and having different polarities from among a plurality of voltages. This enables a change of the voltage level to be decreased, whereby the circuit scale and power consumption can be decreased. Moreover, the pixel can be shifted to the display-OFF-state in the period T42 without causing a DC component to be applied to the liquid crystal element.

In a period T44 (display OFF signal XDOFF is "L", pre/post display signal XPRPO is "L"), the voltage level MV1 (first voltage) is set at the same potential as the center voltage level VC (fixed voltage) when the voltage level V1 (second voltage) is selected based on the polarity inversion signal (voltage setting step). The voltage level MV1 set at the same potential as the center voltage level VC is output to the signal electrode (fixed voltage drive step).

Figure 7:
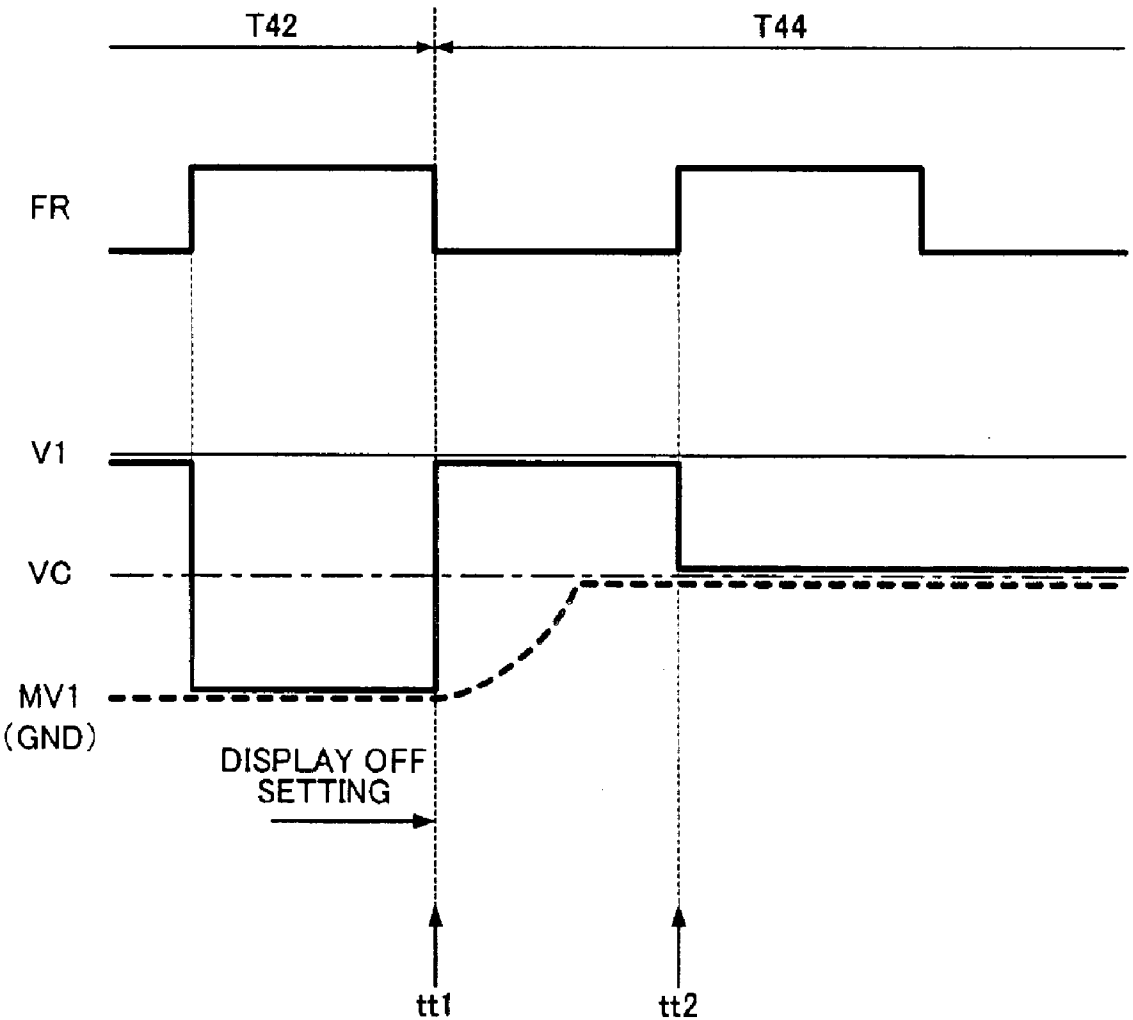
FIG. 7 is a timing chart showing an example of timing of display-OFF-control.

FIG. 7 shows an example of the display control timing from the period T42 to the period T44.

The polarity inversion signal FR is repeatedly inverted in the polarity inversion cycle. In the period T42, the voltage level MV1 is output to the signal electrode when the polarity inversion signal FR is at a logic level "H", and the voltage level V1 is output to the signal electrode when the polarity inversion signal FR is at a logic level "L". When the pre/post display signal XPRPO is set at "L" by allowing display OFF setting to be performed before a time tt1, the voltage level V1 is selected in the next polarity inversion cycle. Therefore, the selector circuit 22 of the power supply circuit 18 changes the voltage level MV1 (selected voltage) so that the voltage level MV1 is set at the same potential as the center voltage level VC (other voltage in a broad sense) from the previously selected system power supply ground level GND (one voltage in a broad sense). The multi-valued voltage select circuit 20 fixedly outputs the voltage level MV1 set at the same potential as the center voltage level VC after a time tt2 (after the selected voltage is changed to the center voltage level VC (fixed voltage) in abroad sense) irrespective of the state of the polarity inversion signal FR.

In the case of performing the display-OFF-control when turning OFF the system power supply, the voltage levels V3, V1, VC, and MV3 generated by the power supply circuit 18 are changed to the system power supply ground level GND in a system power supply OFF period T46 (display OFF signal XDOFF is "L", pre/post display signal XPRPO is "L"). Since the voltage level MV1 is selected so as to be at the same potential as the center voltage level VC, the voltage level MV1 is changed together with the center voltage level VC.

The above control eliminates the need to provide a circuit which generates the center voltage level VC merely for driving the signal electrode to the signal driver 14. Moreover, a DC component is not applied to the liquid crystal element when the pixel is shifted to the liquid crystal display-OFF-state.

In this embodiment, the display-OFF-control is performed by the display OFF signal XDOFF and the pre/post display signal XPRPO. The first and second display control signals shown in FIG. 3 are easily generated according to FIG. 6 based on the display OFF signal XDOFF and the pre/post display signal XPRPO. For example, two bits of signals may make up the first display control signal. In this case, the first display control signal may be generated so that the first bit of the first display control signal is activated when both the display OFF signal XDOFF and the pre/post display signal XPRPO are at a logic level "H" in the normal operation output period (period T40), in which the multi-valued voltage select circuit 20 shown in FIG. 3 selects the output voltage from among a plurality of the voltages based on the grayscale data and the polarity inversion signal. The second bit of the first display control signal may be activated when the display OFF signal XDOFF is at a logic level "L" and the pre/post display signal XPRPO is at a logic level "H" in the period in which the voltage levels V1 and MV1 are alternately output based on the polarity inversion signal. The pre/post display signal XPRPO may be used as the second display control signal for allowing either the center voltage level VC or the system power supply ground level GND to be selected by the selector circuit 22.

2.2 Display-ON-Control

The display-ON-control is described below with reference to FIGS. 6 and 8.

The signal driver 14 shifts the pixel from the liquid crystal display-OFF-state to the liquid crystal display-ON-state by the display-ON-control described below. The display-ON-control is essentially performed by a procedure the reverse to the display-OFF-control.

In the case of performing the display-ON-control when turning ON the system power supply, the voltage levels V3, V1, VC, and MV3 are set at the original voltage levels by the power supply circuit 18 in a system power supply ON period T50 (display OFF signal XDOFF is "L", pre/post display signal XPRPO is "L"). The original voltage levels are determined by the MLS operation results used in 3MLS. The voltage level MV1 (first voltage in a broad sense) is selected at the center voltage level VC and at the same potential as the center voltage level VC.

In a period T52 (display OFF signal XDOFF is "L", pre/post display signal XPRPO is "L"), the voltage level MV1 is selected at the same potential as the center voltage level VC by the selector circuit 22 in a state in which the voltage level output to the scan electrodes is fixed at the center voltage level VC (given fixed voltage) (fixed voltage drive step).

In a period T54 (display OFF signal XDOFF is "L", pre/post display signal XPRPO is "H"), the voltage levels V1 (second voltage) and MV1 (first voltage) are alternately supplied to the signal electrode based on the polarity inversion signal in a state in which the voltage level output to the scan electrodes is fixed at the center voltage level VC (polarity inversion drive step). In this example, the number of voltage levels necessary for driving the signal electrode is two. In the case where three or more voltage levels are necessary in other drive methods, the multi-valued voltage select circuit 20 selects the first voltage and the second voltage having the smallest absolute value and different polarities based on the center voltage level VC (voltage level shared between the scan electrode and the signal electrode in a broad sense) from among a plurality of voltages. This enables the pixel to be shifted to the display-ON-state in the period T54 without causing a DC component to be applied to the liquid crystal element.

Figure 8:
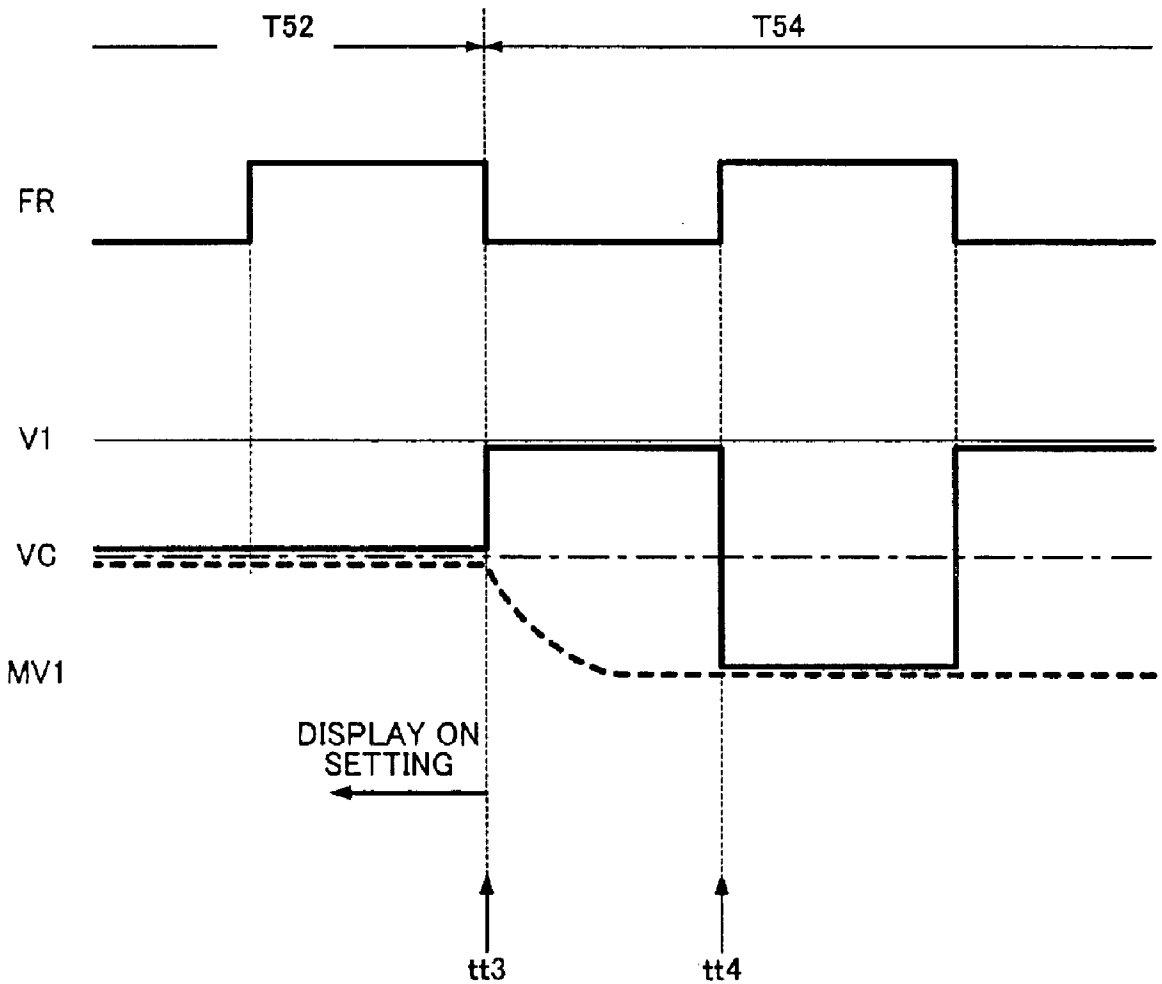
FIG. 8 is a timing chart showing an example of timing of display-ON-control.

FIG. 8 shows an example of the display control timing from the period T52 to the period T54.

The selector circuit 22 selectively outputs the voltage level MV1 in the period T52 irrespective of the logic level of the polarity inversion signal. The voltage level MV1 is set at the same potential as the center voltage level VC. When the pre/post display signal XPRPO is set at "H" by allowing display ON setting to be performed before a time tt3, the voltage level V1 (second voltage) is selected in the next polarity inversion cycle. Therefore, the selector circuit 22 of the power supply circuit 18 changes the voltage level MV1 (selected voltage) so that the voltage level MV1 is at the same potential as the system power supply ground level GND (voltage differing from the fixed voltage in a broad sense) from the previously selected center voltage level VC (fixed voltage), and outputs the voltage level MV1. The multi-valued voltage select circuit 20 alternately outputs the voltage levels V1 and MV1 in the polarity inversion cycle specified by the polarity inversion signal FR after a time tt4 (until the selected voltage level is changed to the system power supply ground level GND (first voltage) in a broad sense). For example, the voltage level MV1 is output to the signal electrode when the polarity inversion signal FR is at a logic level "H", and the voltage level V1 is output to the signal electrode when the polarity inversion signal FR is at a logic level "L".

The signal driver 14 supplies the output voltage selected from among a plurality of voltages to the signal electrode based on the grayscale data and the polarity inversion signal in a normal operation output period T40 (display OFF signal XDOFF is "H", pre/post display signal XPRPO is "H") (signal drive step). Specifically, the scan driver 16 outputs the voltage levels V3 and MV3 corresponding to the scan pattern of the simultaneously selected three scan electrodes and the dummy scan pattern corresponding to the scan pattern to the scan electrodes in the selected period of the pixel. The scan driver 16 outputs the center voltage level VC to the scan electrodes in the nonselected period of the pixel. The signal driver 14 outputs either the voltage level V1 or MV1 to the signal electrode in a cycle corresponding to the polarity inversion signal based on the grayscale data corresponding to the scan pattern and the dummy scan pattern.

It is unnecessary to provide a circuit which generates the center voltage level VC merely for driving the signal electrode by controlling the signal driver and the scan driver in the above-described sequence. Therefore, the pixel can be shifted to the liquid crystal display-ON-state without allowing a DC component to be applied to the liquid crystal element.

The signal driver and the scan driver which perform the above-described display control are described below in detail.

3. Signal Driver

The signal driver 14 uses two voltage levels for driving the signal electrode by employing the concept of the virtual electrode, and drives the liquid crystal panel by using 3MLS at a contrast equal to 4MLS. The signal driver 14 decodes and outputs the MLS operation results obtained in advance without performing complicated 4MLS operations each time the signal electrode is driven, whereby the circuit configuration can be significantly simplified. In more detail, the MLS operations are performed in advance on the display patterns for three lines and the dummy display pattern corresponding to the display patterns for three lines by using orthogonal functions specified by the combination of the scan pattern of the simultaneously selected three scan electrodes and the dummy scan pattern corresponding to the scan pattern. Decoder circuits are provided for decoding and outputting the MLS operation results corresponding to a field signal. This enables the decoder circuits to be provided for each bit of grayscale data, thereby eliminating the need for a conventional complicated MLS operation circuit.

An MLS decoder (decoder circuit in a broad sense) which decodes and outputs the 4MLS operation results by using the scan pattern of the simultaneously selected three lines and the display patterns for three lines corresponding to the scan pattern is described below. The MLS decoder is included in the signal driver 14.

3.1 MLS Decoder

Figure 9:
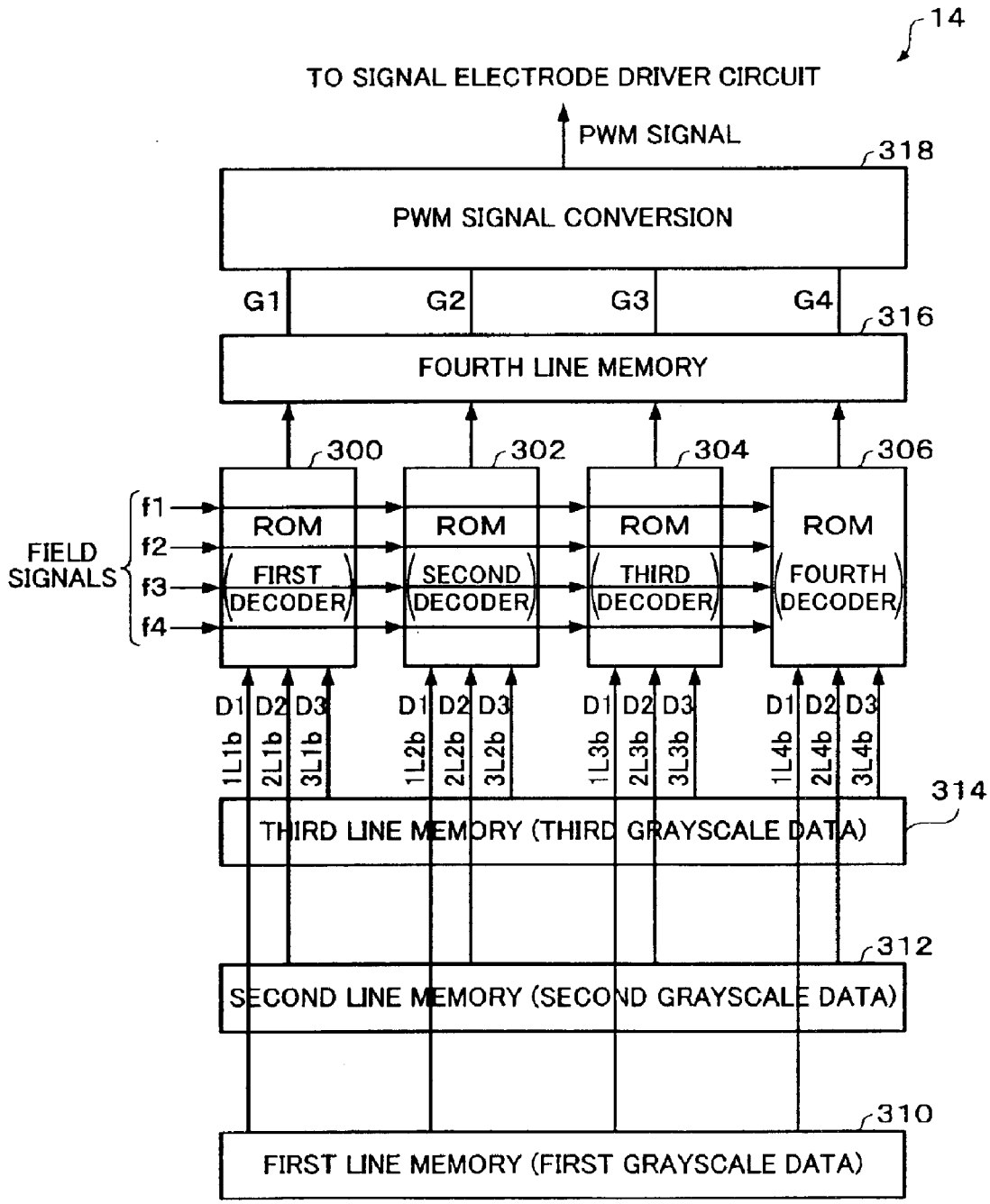
FIG. 9 is a configuration diagram showing a feature of a configuration of the signal driver including an MLS decoder.

FIG. 9 shows a feature of a configuration of the signal driver including the MLS decoder.

The signal driver 14 functions as a signal driver which drives the signal electrodes. FIG. 9 shows the configuration of a unit of one signal electrode (segment). The following description is given on the assumption that the number of bits m of grayscale data is "4" ($2^4$=16 grayscales).

The MLS decoder may be formed by using one or more read only memories (hereinafter abbreviated as "ROMs") provided for each bit of the grayscale data. In the case where the grayscale data is four bits, the MLS decoder may be formed by using four ROMs.

The signal driver 14 includes ROMs (first to fourth (mth) decoder circuits in a broad sense) 300, 302, 304, and 306 as the MLS decoders in units of bits of the grayscale data. A display pattern corresponding to the scan pattern of the simultaneously selected three scan electrodes is supplied to the ROMS 300, 302, 304, and 306 in units of bits. Therefore, the kth ($1 \leqq k \leqq m$, k is a natural number) bits of the grayscale data for three lines corresponding to the scan pattern of the simultaneously selected three scan electrodes are input to the kth decoder circuit. In more detail, if the 4-bit grayscale data consists of the first to fourth bits, the first bits (three bits consisting of 1L1*b* to 3L1*b*) of the grayscale data corresponding to the display pattern for three lines are supplied to the ROM 300. The second bits (three bits consisting of 1L2*b* to 3L2*b*) of the grayscale data corresponding to the display pattern for three lines are supplied to the ROM 302. The third bits (three bits consisting of 1L3*b* to 3L3*b*) of the grayscale data corresponding to the display pattern for three lines are supplied to the ROM 304. The fourth bits (three bits consisting of 1L4*b* to 3L4*b*) of the grayscale data corresponding to the display pattern for three lines are supplied to the ROM 306. The ROMs 300, 302, 304, and 306 output two-valued signals (decoded output signals) in response to field signals f1 to f4 by using the MLS operation results determined in field units.

The signal driver 14 may include first to third line memories 310, 312, and 314 which hold the grayscale data for each signal electrode corresponding to the scan pattern of simultaneously selected scan electrodes. In this case, the first line memory 310 supplies each bit of first grayscale data held therein to the ROMs 300, 302, 304, and 306. The second and third line memories 312 and 314 supply each bit of second and third grayscale data respectively held therein to the ROMs 300, 302, 304, and 306. In the case where the signal driver 14 includes a display data RAM which stores the grayscale data, the display data RAM may be allowed to have the same functions as the first to third line memories 310, 312, and 314.

The signal driver 14 may include a fourth line memory 316 which holds the decoded results output from the ROMs 300, 302, 304, and 306 in bit units.

The MLS operation results decoded and output from the ROMs 300, 302, 304, and 306 are pulse width modulated and output to the signal electrode. In FIG. 9, the MLS operation results decoded and output from the ROMs 300, 302, 304, and 306 are latched by the fourth line memory 316 and pulse width modulated by a pulse width modulation (PWM) signal conversion circuit 318.

The PWM signal conversion circuit 318 generates a PWM signal having a pulse width corresponding to the MLS operation results latched by the fourth line memory 316, and outputs the PWM signal to the signal electrode driver circuit (not shown) provided for each signal electrode. The PWM signal conversion circuit 318 may be formed so that the PWM signal conversion circuit 318 outputs the PWM signal having a pulse width corresponding to the MLS operation results by changing a signal level of coincidence detection results based on the coincidence detection results between a count value which is counted by a clock for pulse width clocking and the decoded and output MLS operation results.

The signal electrode driver circuit drives the signal electrode based on the PWM signal.

The present invention is not limited to the number of bits of the grayscale data or the number of bits of the MLS operation results.

The MLS decoder is described below in detail.

3.1.1 3MLS

In this embodiment, the scan pattern of the simultaneously selected three scan electrodes is output to the signal electrode using the 4MLS operation results for the scan pattern of scan electrodes for four lines by employing a concept of a dummy scan electrode (virtual electrode).

Figure 10:
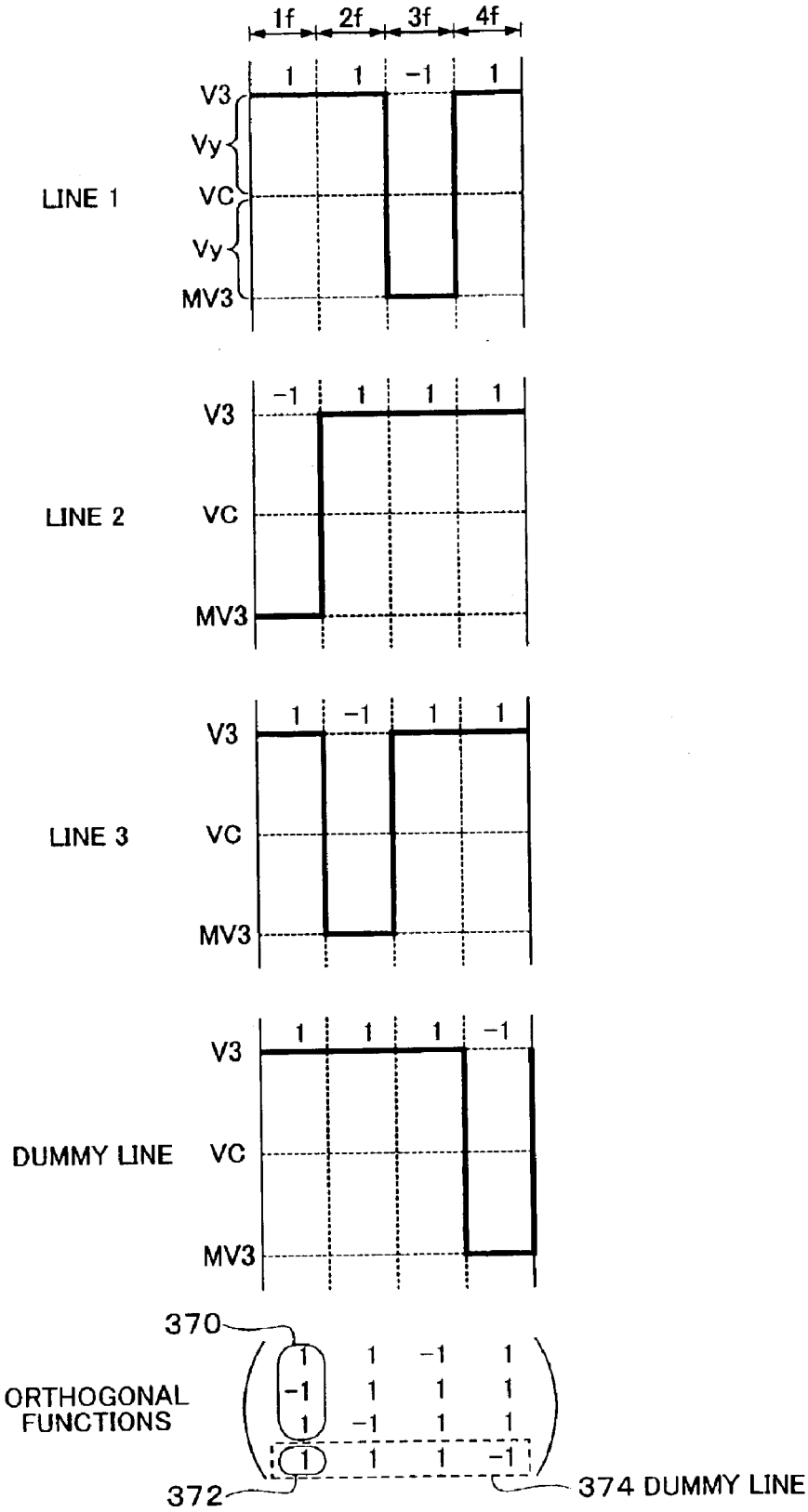
FIG. 10 is a waveform diagram showing an example of a scan pattern output to scan electrodes.

FIG. 10 shows an example of the scan patterns output to the scan electrodes.

In FIG. 10, the scan patterns output to the simultaneously selected three scan electrodes are illustrated in each field as common waveforms (scan electrode drive waveforms, COM waveforms). The scan driver outputs one of voltage levels V3 (=VC+Vy) and MV3 (=VC−Vy) having the same amplitude (=Vy) and different polarities with respect to the center voltage level VC to the scan electrodes in each field.

The voltage level V3 is referred to as "1", and the voltage level MV3 is referred to as "−1". In the case where one of the simultaneously selected scan electrodes is "−1" in 1*f* (field) to 3*f*, the scan pattern is prescribed so that the dummy scan electrode (dummy line) becomes "−1" in 4*f*.

As shown in FIG. 11, the scan driver 16 is capable of outputting each scan pattern shown in FIG. 10 to the scan electrodes by supplying the voltage level V3 corresponding to "1" or the voltage level MV3 corresponding to "−1" to each scan electrode based on the field signals f1 to f4 corresponding to four states expressed by two bits of field setting signals F1 and F2.

The scan patterns supplied to the simultaneously selected three scan electrodes may be expressed as quartic orthogonal functions as shown in FIG. 10 by allowing the scan patterns in 1*f* to 4*f* in each line to make up components in each row. This orthogonal function is prescribed in each field by a scan pattern 370 of the simultaneously selected three scan electrodes and a scan pattern 372 of the virtual scan electrode (dummy line) corresponding to the scan pattern 370. Therefore, a scan pattern 374 of the dummy scan electrode is expressed in the fourth row. The orthogonal functions can be expressed in the same manner in the case where the number of simultaneously selected scan electrodes is n.

The segment waveforms in the case of 4MLS by using such scan patterns are described below.

FIGS. 12A to 12H and FIGS. 13A to 13H schematically show the segment waveforms in the case of 4MLS.

The segment waveforms are illustrated for all the display patterns corresponding to the above scan patterns.

In the case of 4MLS, the number of voltage levels necessary for driving the signal electrode is generally five. The voltage levels in each field are indicated by "−2", "−1", "0", "1", and "2". The voltage levels are referred to as V2, V1, VC, MV1, and MV2. The voltage level VC which can be shared between the signal driver and the scan driver is referred to as "0", the voltage level V2 is referred to as "2", the voltage level V1 is referred to as "1", the voltage level MV1 is referred to as "−1", and the voltage level MV2 is referred to as "−2". The five values of voltage levels V2, V1, VC, MV1, and MV2 satisfy the following relational equations.

$$V2=VC+2Vx \quad (1)$$

$$V1=VC+Vx \quad (2)$$

$$MV1=VC-Vx \quad (3)$$

$$MV2=VC-2Vx \quad (4)$$

Voltage applied to a liquid crystal layer in each line and each field is illustrated for each display pattern. The voltage applied to the liquid crystal layer is the difference between the voltage level of the scan electrode and the voltage level of the signal electrode. In the case of a display pattern (0,0,1,1) shown in FIG. 12D, since the scan electrode is at the voltage level V3 in 1*f* in the first line as shown FIG. 10 and the signal electrode is at the voltage level MV1, the voltage applied to the liquid crystal layer is (V3−MV1)(= VC+Vy−(VC−Vx)=Vy+Vx). Similarly, since the scan electrode is at the voltage level V3 and the signal electrode is at the voltage level V1 in 2*f* in the first line, the voltage applied to the liquid crystal layer is Vy−Vx. In the case of a display pattern (1,1,0,1) shown in FIG. 13F, the voltage applied to the liquid crystal layer is VC in 1*f* in the first line. The voltage applied to the liquid crystal layer is Vy+2Vx in 2*f* in the first line.

Evaluation values corresponding to the root-mean-square values of the voltage applied to the liquid crystal layer in each line are shown in FIGS. 12A to 12H and FIGS. 13A to 13H taking only the selected period into consideration. These evaluation values in each line are the sum of the squares of the applied voltages in each field. As a result, the evaluation values consist of two values expressed by $Voff^2$ or $Von^2$.

Figure 12A:
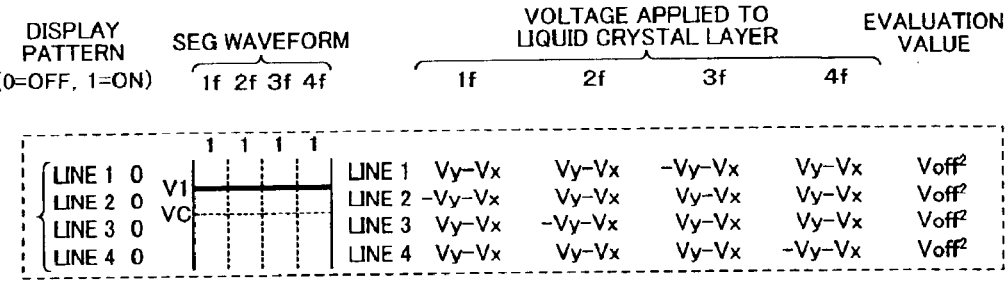
FIGS. 12A to 12H are explanatory diagrams showing segment waveforms, voltage applied to a liquid crystal layer, and an evaluation value in the case of 4MLS.
Figure 12B:
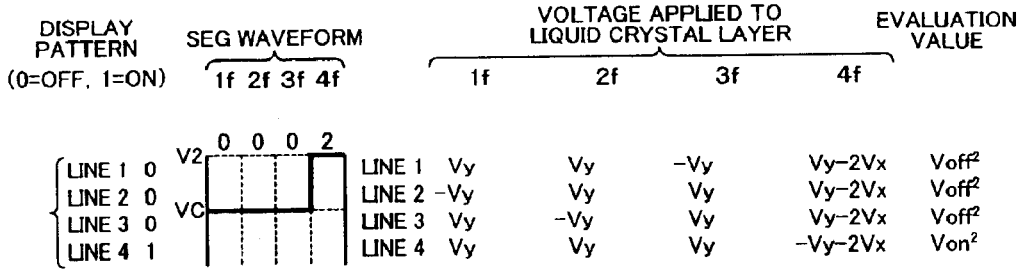
Figure 12C:
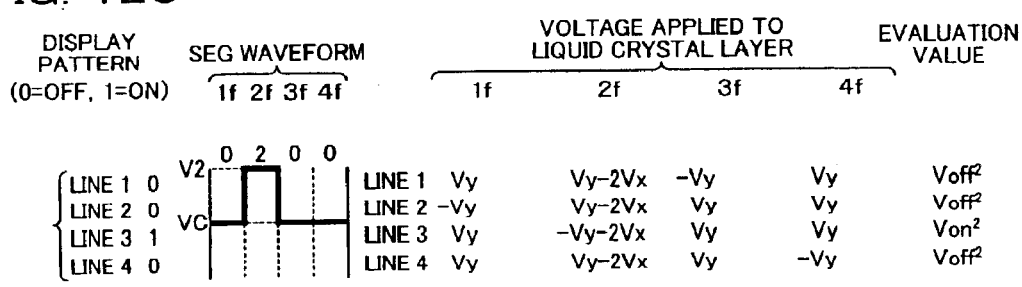
Figure 12D:
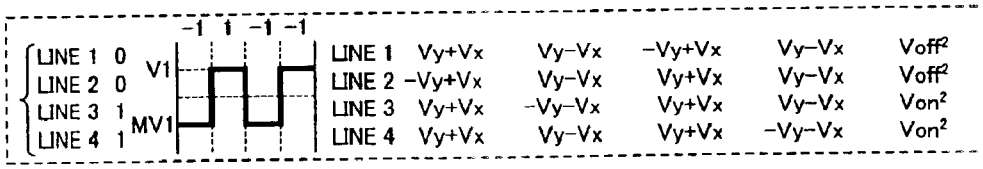
Figure 12E:
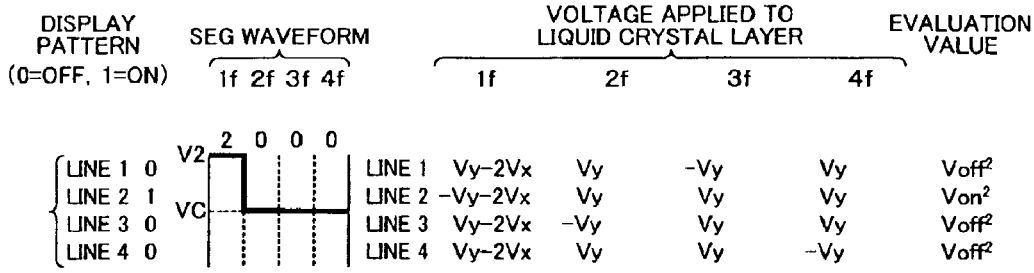
Figure 12F:
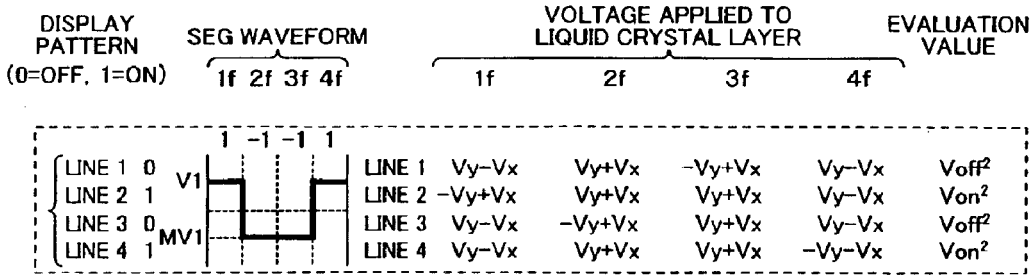
Figure 12G:
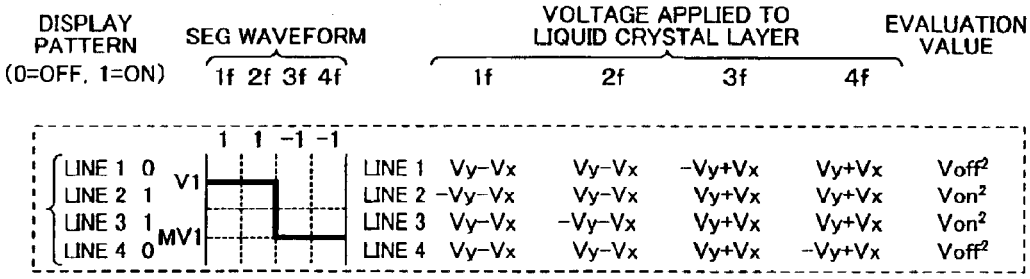
Figure 12H:
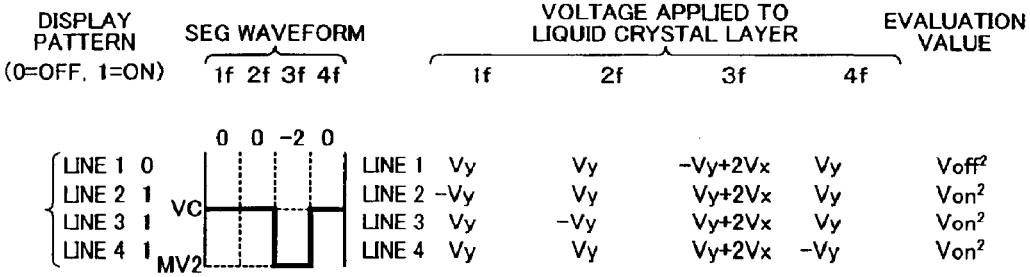
Figure 13A:
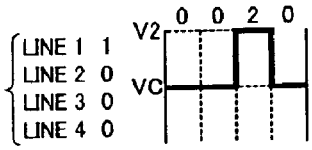
FIGS. 13A to 13H are explanatory diagrams showing segment waveforms, voltage applied to a liquid crystal layer, and an evaluation value in the case of 4MLS.
Figure 13B:
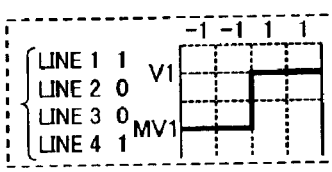
Figure 13C:
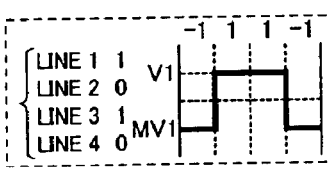
Figure 13D:
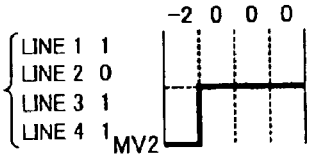
Figure 13E:
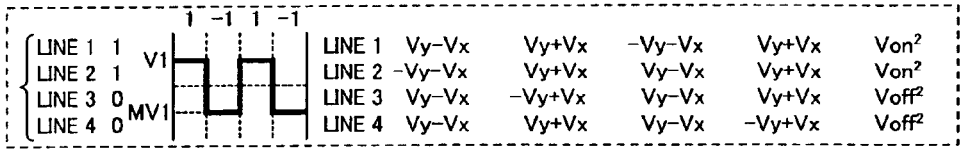
Figure 13F:
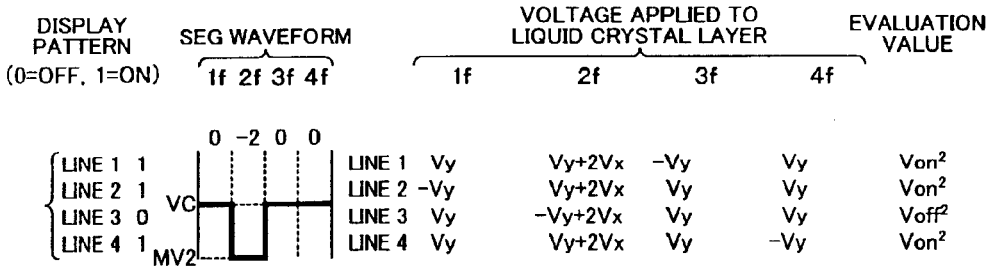
Figure 13G:
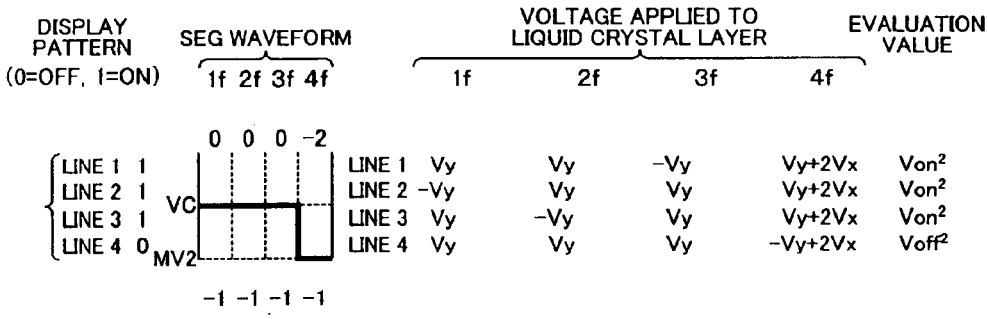
Figure 13H:
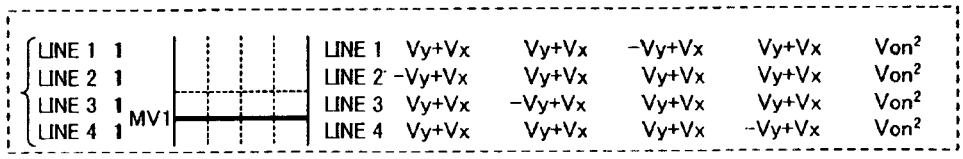

As shown in FIGS. 12A to 12H and FIGS. 13A to 13H, each two display patterns have the same pattern in the first line to the third line. For example, the first line to the third line of the display pattern shown in FIG. 12A are the same as the first line to the third line of the display pattern shown in FIG. 12B. This also applies to the display patterns shown in FIG. 12C and FIG. 12D, FIG. 12E and FIG. 12F, . . . , FIG. 13A and FIG. 13B, . . . , and FIG. 13G and FIG. 13H. For example, the evaluation values in the first line to the third line are the same in FIG. 12A and FIG. 12B, but only the evaluation values in the fourth line differ. This also applies to the display patterns shown in FIG. 12C and FIG. 12D, FIG. 12E and FIG. 12F, . . . , FIG. 13A and FIG. 13B, . . . , and FIG. 13G and FIG. 13H.

In one of the display patterns in each combination, the segment waveform uses only two values of the voltage levels V1 and MV1. Specifically, these display patterns consist of (0,0,0,0) (FIG. 12A), (0,0,1,1) (FIG. 12D), (0,1,0,1) (FIG. 12F), (0,1,1,0) (FIG. 12G), (1,0,0,1) (FIG. 13B), (1,0,1,0) (FIG. 13C), (1,1,0,0) (FIG. 13E), and (1,1,1,1) (FIG. 13H) (eight patterns in total). Therefore, contrast equal to 4MLS can be realized in the first line to the third line by using these eight patterns. Moreover, the voltage level of the segment waveform corresponding to each display pattern can be expressed by two values.

3.1.2 Decode

FIGS. 14A to 14H schematically show the segment waveforms by using 3MLS in this embodiment.

Each display pattern is the segment waveform selected from the segment waveforms shown in FIGS. 12A to 12H and FIGS. 13A to 13H as described above.

In the case of outputting these segment waveforms by using 3MLS, the display pattern in the fourth line corresponding to the display patterns in the first line to the third line is determined as the dummy display pattern (dummy pattern). In FIGS. 14A to 14H, the dummy pattern is selected so that the number of "1" of the display patterns in each line is an even number (0, 2, or 4).

The MLS operation results corresponding to the segment waveforms in which the voltage levels consist of two values as shown in FIGS. 14A to 14H can be obtained by the MLS operations on the display patterns for four lines in the same manner as in 4MLS using the orthogonal functions shown in FIG. 10. Therefore, contrast equal to 4MLS can be realized by outputting the voltage level V1 or MV1 in each field using the resulting MLS operation results.

FIG. 15 shows a relation between the display pattern and the MLS operation results in this embodiment.

ON and OFF of the display pattern respectively correspond to "−1" and "1". Either "1" or "−1" is selected as the dummy pattern so that the number of "1" or "−1" is an even number (0, 2, or 4).

As shown in FIG. 15, each display pattern by 4MLS can be covered by using only the eight patterns shown in FIGS. 14A to 14H. Therefore, the 4MLS operation results can be obtained by the MLS operations on each display pattern shown in FIG. 15. For example, "−1" is selected as a dummy pattern 402 corresponding to a display pattern 400 so that the number of "1" or "−1" of each element of the display pattern 400 and the dummy pattern 402 is an even number (0, 2, or 4). MLS operation results (given operation results) 404 are obtained by matrix operations (MLS operations, given operations) on the display pattern 400 and the dummy pattern 402 based on the orthogonal functions shown in FIG. 10. The MLS operation results 404 are the 4MLS operation results and either "2" or "−2" is obtained in each field. The segment waveform shown in FIG. 14B can be expressed by associating "2" and "−2" with the voltage levels V1 and MV1, respectively.

Therefore, a truth table described below can be obtained for the MLS decoder which decodes and outputs in each field.

FIG. 16 shows an example of a truth table of the MLS decoder in this embodiment.

"1" and "0" in the display patterns D1 to D3 respectively correspond to ON and OFF. A decoded output OUT is at the voltage level V1 when "H", and at the voltage level MV1 when "L". 1*f* is specified by allowing the field signal f1 to be at a logic level "H". 2*f* is specified by allowing the field signal f2 to be at a logic level "H". 3*f* is specified by allowing the field signal f3 to be at a logic level "H". 4*f* is specified by allowing the field signal f4 to be at a logic level "H".

D1 indicates the display pattern in the first line corresponding to the simultaneously selected three scan electrodes. D2 indicates the display pattern in the second line corresponding to the simultaneously selected three scan electrodes. D3 indicates the display pattern in the third line corresponding to the simultaneously selected three scan electrodes.

According to this truth table, the following decode functions can be realized. In the case where the field signal f1 is "H", if the display patterns D1 to D3 are (1,0,0), MLS operation results 412 by the orthogonal functions shown in FIG. 10 are obtained by using the dummy pattern 410 (ON (−1)) corresponding to the display pattern (ON (−1), OFF (1), OFF (1)) in FIG. 15. Therefore, a logic level "L" is output as the decoded output OUT in if so that the voltage level MV1 corresponding to the voltage level "−2" shown in FIG. 15 is output.

Grayscale display can be realized by providing the decoder circuits having the same decoding functions in units of bits of the grayscale data. In this embodiment, the ROMs 300, 302, 304, and 306 output the decoded results according to the above truth table.

As described above, the decoder circuits which output the decoded output signals corresponding to the fields from the 4MLS operation results based on the scan pattern for the simultaneously selected three scan electrodes and the display patterns of the signal electrode for three lines are provided in units of bits. Therefore, 3MLS can be realized without generating a dummy display pattern corresponding to the virtual electrode or the like. Moreover, the voltage levels necessary for driving the signal electrode can be binarized in 3MLS, and contrast equal to 4MLS can be realized. Furthermore, since it is unnecessary to perform the MLS operations, the configuration can be significantly simplified.

3.2 Detailed Example of Configuration 3.2.1 Signal Driver

A detailed configuration example of the signal driver 14 including the MLS decoder is described below.

Figure 17:
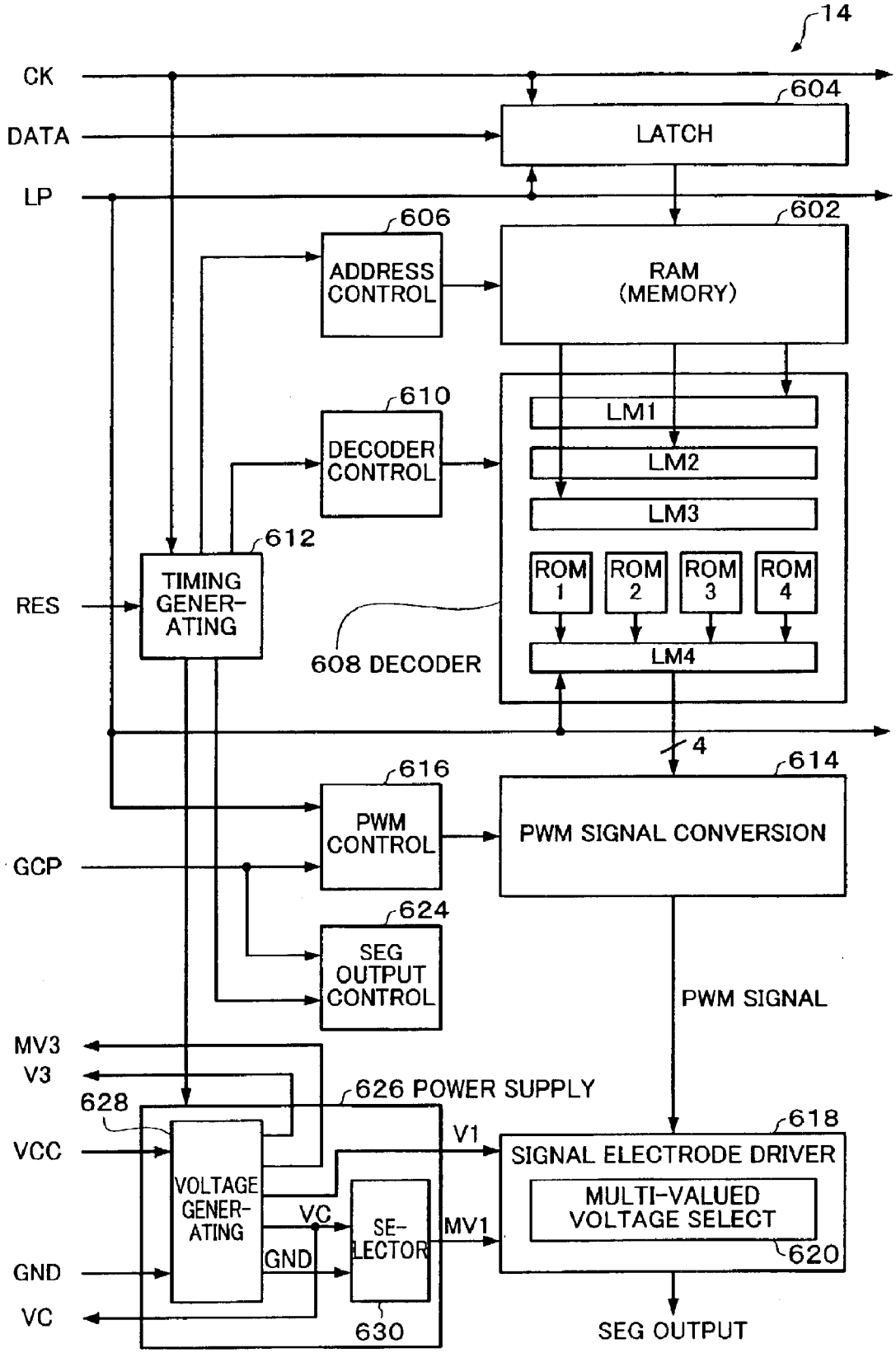
FIG. 17 is a block diagram showing a detailed example of a configuration of the signal driver.

FIG. 17 shows a detailed example of a configuration of the signal driver 14.

FIG. 17 shows only a block diagram corresponding to one bit of output in order to simplify the description.

The signal driver 14 includes a RAM 602 which stores one frame of the grayscale data, for example.

The signal driver 14 includes a latch circuit 604. The latch circuit 604 has a function of a data capturing circuit for writing the grayscale data into the RAM 602 and a function of a line latch. A clock CK for capturing the grayscale data, grayscale data DATA, and a latch pulse LP are input to the latch circuit 604.

An address control circuit 606 controls writing of the grayscale data output from the latch circuit 604 into the RAM 602, or controls reading of the grayscale data from the RAM 602.

The grayscale data read from the RAM 602 is supplied to a decoder circuit 608. As the decoder circuit 608, the configuration shown in FIG. 9 may be employed, for example. In this case, the decoder circuit 608 includes first to fourth line memories LM1 to LM4, and ROM1 to ROM4 which are provided in units of bits of the grayscale data and output the decoded data according to the truth table shown in FIG. 16. The decoder circuit 608 is controlled by a decoder control circuit 610. In more detail, the decoder control circuit 610 supplies the field signal shown in FIG. 9 in response to the field display timing.

In the decoder circuit 608, the first to third line memories LM1 to LM3 may be omitted by assigning the functions of the first to third line memories LM1 to LM3 to the RAM 602.

The address control circuit 606 and the decoder control circuit 610 are controlled by a timing generating circuit 612. The timing generating circuit 612 specifies timing necessary for controlling reading or writing of the grayscale data and decode control timing of the grayscale data read from the RAM 602 by the field signals f1 to f4 (or field setting signals F1 and F2) corresponding to the display timing, by using the clock CK and the reset signal RES.

The decoded output of the decoder circuit 608 is supplied to a PWM signal conversion circuit 614. The PWM signal conversion circuit 614 is controlled by a PWM control circuit 616. The PWM control circuit 616 allows the PWM signal conversion circuit 614 to specify the pulse width based on the coincidence detection results between the count value counted by a clock GCP for pulse width clocking and the MLS operation results latched by the fourth line memory LM4, for example. In this case, a count value reset by the latch pulse signal LP in one horizontal scan cycle may be used, for example.

In the case where PWM modulation in the PWM signal conversion circuit 614 is performed so that the pulse width is determined based on the coincidence detection results, if the delay of each bit of the MLS operation results cannot be ignored, the delay of each bit may be made uniform by allowing each bit of the MLS operation results to be latched by the fourth line memory LM4. Therefore, the determined pulse width does not deviate from the MLS operation results. However, in the case where the delay of each bit of the MLS operation results input to the PWM signal conversion circuit 614 may be ignored, the fourth line memory LM4 may be omitted.

A signal electrode driver circuit 618 drives the signal electrode based on the PWM signal. In this example, the multi-valued voltage select circuit 620 is included in the signal electrode driver circuit 618. The multi-valued voltage select circuit 620 selects one output voltage from a plurality of the voltage levels as shown in FIGS. 3 and 4, and outputs the output voltage to the signal electrode. Since two voltage levels are used in MLS drive in this example, the multi-valued voltage select circuit 620 selectively outputs either the voltage level V1 or MV1.

The signal electrode driver circuit 618 is controlled by an SEG output control circuit 624. The SEG output control circuit 624 may control the signal electrode driver circuit 618 based on the display timing generated by the timing generating circuit 612 and the clock GCP.

The signal driver 14 includes a power supply circuit 626. The power supply circuit 626 includes a voltage generating circuit 628 and a selector circuit 630. A system power supply voltage level VCC and the system power supply ground level GND are supplied to the power supply circuit 626. The voltage generating circuit 628 boosts the difference between the system power supply voltage level VCC and the system power supply ground level GND by c times (c is an optional number excluding 0) to generate the voltage levels V3, MV3, VC, and V1. The voltage levels V3, MV3, and VC are output to outside the signal driver 14 and supplied to the scan driver 16, for example. The voltage level VC and the system power supply ground level GND are input to the selector circuit 630. As the selector circuit 630, the circuit configuration shown in FIG. 5 may be employed. The output of the selector circuit 630 is supplied to the signal electrode driver circuit 618 as the voltage level MV1. The voltage level V1 is also supplied to the signal electrode driver circuit 618.

Figure 18:
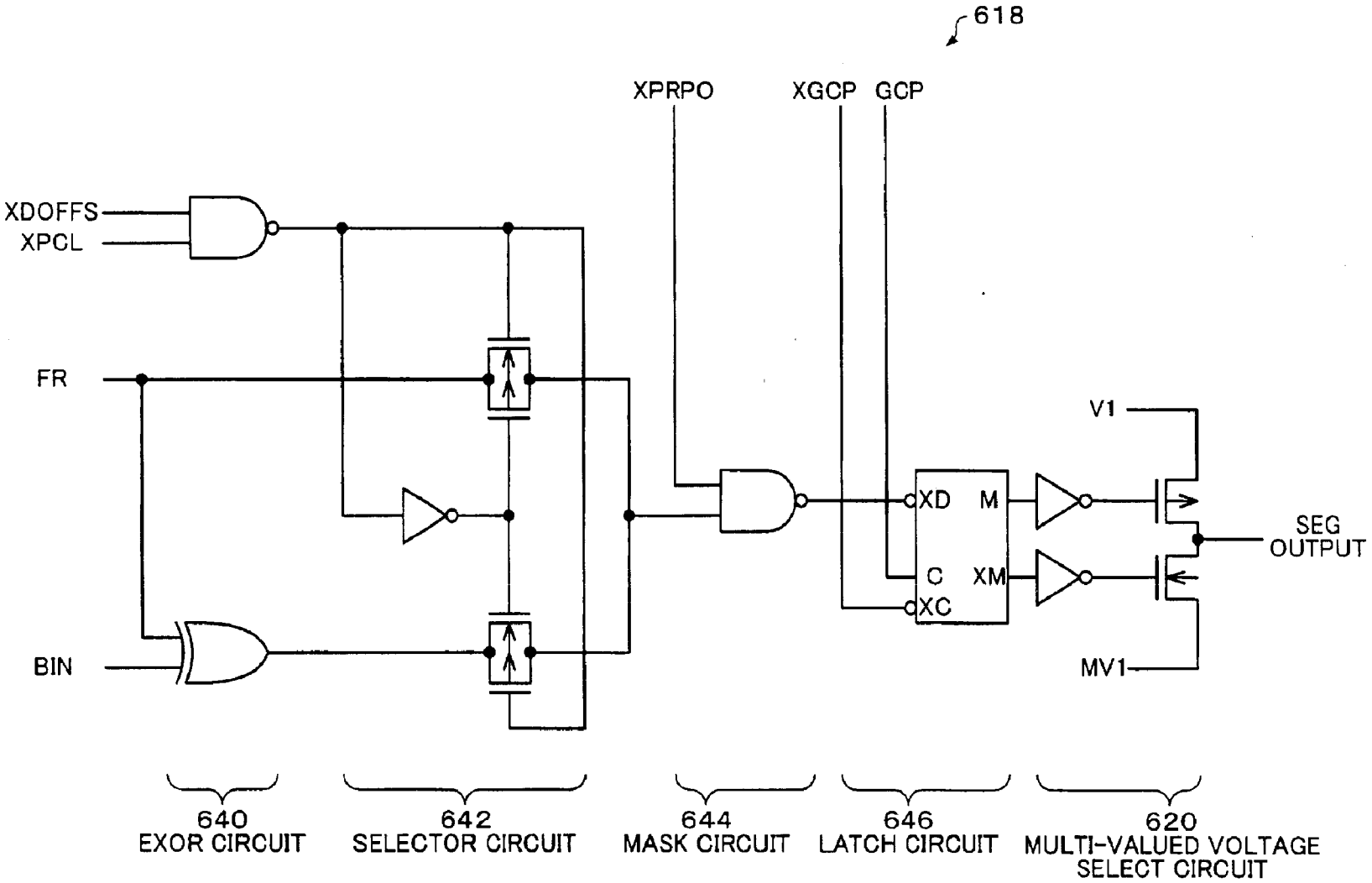
FIG. 18 is a circuit configuration diagram showing an example of a circuit configuration of a signal electrode driver circuit.

FIG. 18 shows an example of a circuit configuration of the signal electrode driver circuit 618.

A display OFF signal XDOFFS is equivalent to the display OFF signal XDOFF shown in FIG. 6. The display OFF signal XDOFFS sets the entire liquid crystal panel to be in the liquid crystal display-OFF-state in the signal driver 14. The display OFF signal XDOFFS is capable of setting a period other than the normal operation output period as shown in FIG. 6. A partial signal XPCL sets only a partial non-display area in the entire display region of the liquid crystal panel to be in the liquid crystal display-OFF-state. The polarity inversion signal FR specifies the polarity inversion cycle. A PWM signal BIN is generated by the PWM signal conversion circuit 614. The pre/post display signal XPRPO prevents a DC component from being applied to the liquid crystal element by the performance of polarity inversion drive at the voltage levels V1 and MV1 before and after the normal operation output period in the display-OFF-control or the display-ON-control as shown in FIG. 6. The clock GCP is a clock for pulse width clocking by PWM. An inversion clock XGCP is an inversion signal of the clock GCP.

The PWM signal BIN and the polarity inversion signal FR are input to an exclusive OR (EXOR) circuit 640 in the signal electrode driver circuit 618. The selector circuit 642 selectively outputs either the output signal of the EXOR circuit 640 or the polarity inversion signal FR based on the results of negation (NOT) the conjunction (AND) of the display OFF signal XDOFFS and the partial signal XPCL. The signal selectively output from the selector circuit 642 is masked by the pre/post display signal XPRPO in a mask circuit 644. The output signal of the mask circuit 644 is latched in a latch circuit 646 at a falling edge of the clock GCP. The multi-valued voltage select circuit 620 outputs either the voltage level V1 or MV1 to the signal electrode as the SEG output based on the output signal of the latch circuit 646.

The signal electrode driver circuit 618 is provided corresponding to each signal electrode. The signal electrode driver circuit 618 may be formed so that the single partial signal XPCL is supplied to the signal electrode in units of the partial display control or the partial non-display control, for example.

The EXOR circuit 640 in the signal electrode driver circuit 618 inverts the PWM signal BIN in response to the polarity inversion timing specified by the polarity inversion signal FR. Since the display OFF signal XOFFS or the partial signal XPCL is at a logic level "H" in the normal operation output period as shown in FIG. 6, the selector circuit 642 selects the output signal of the EXOR circuit 640. Since the pre/post display signal XPRPO is at a logic level "H", the mask circuit 644 outputs the signal output from the selector circuit 642 to the latch circuit 646 without masking the signal. The multi-valued voltage select circuit 620 outputs either the voltage level V1 or MV1 based on the signal latched by the latch circuit 646.

When the display OFF signal XOFFS or the partial signal XPCL is at a logic level "L", the selector circuit 642 selects the polarity inversion signal FR. In the case where the pre/post display signal XPRPO is at a logic level "H", the mask circuit 644 outputs the signal output from the selector circuit 642 to the latch circuit 646 without masking the signal. Therefore, the multi-valued voltage select circuit 620 alternately outputs the voltage levels V1 and MV1 in response to the polarity inversion timing of the polarity inversion signal FR latched by the latch circuit 646, as shown in FIG. 6. In the case where the pre/post display signal XPRPO is at a logic level "L", the mask circuit 644 masks the signal output from the selector circuit 642. Therefore, a logic level "L" is output from an M terminal of the latch circuit 646, and a logic level "H" is output from an XM terminal of the latch circuit 646. As a result, the multi-valued voltage select circuit 620 fixedly outputs the voltage level MV1 as shown in FIG. 6.

3.2.2 Scan Driver

A detailed configuration example of the scan driver 16 which drives the liquid crystal panel in cooperation with the signal driver 14 is described below.

Figure 19:
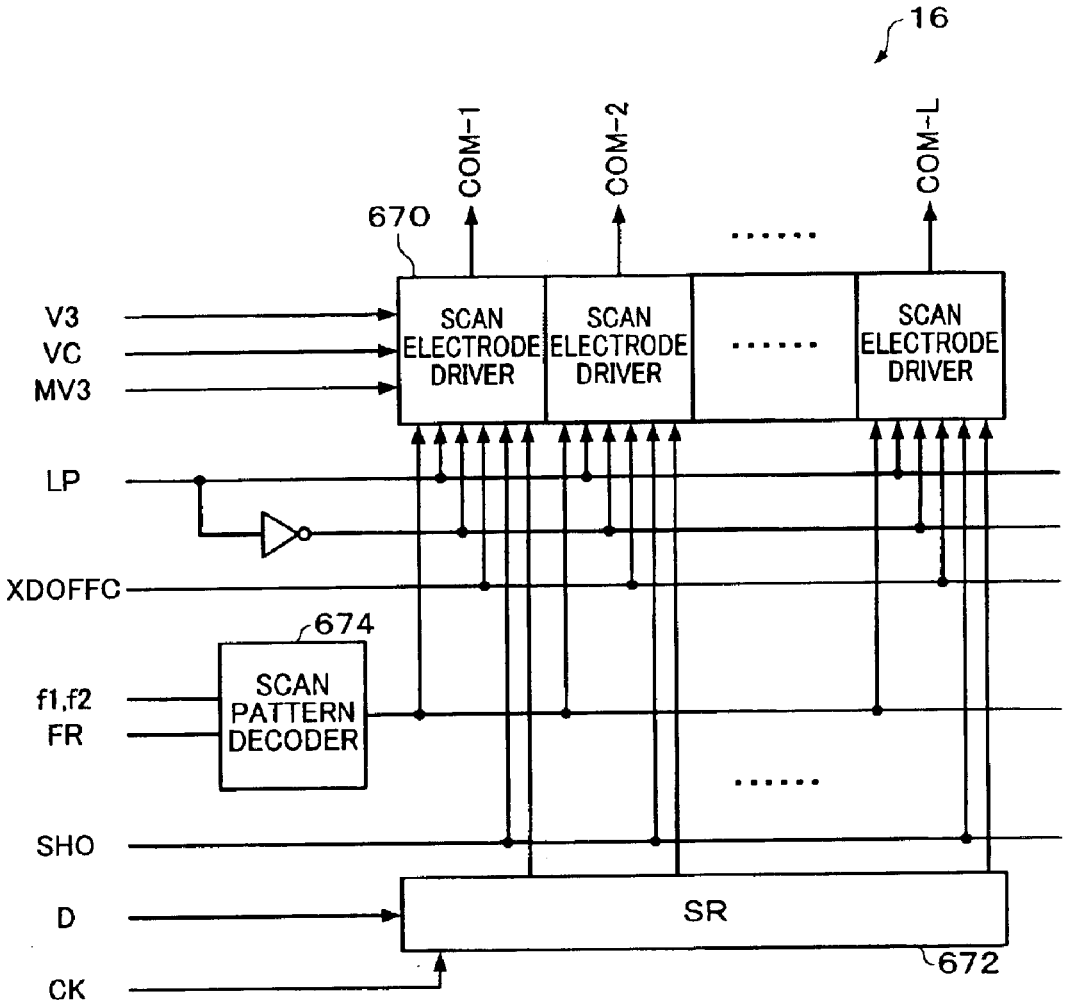
FIG. 19 is a block diagram showing a detailed example of a configuration of the scan driver.

FIG. 19 shows a detailed example of a configuration of the scan driver 16.

In the case of driving L (L is a natural number of one or more) scan electrodes, the scan driver 16 includes scan electrode driver circuits 670 corresponding to each scan electrode. A shift register (SR) 672 is formed by a plurality of flip-flops. Each flip-flop corresponds to three scan electrodes. The SR 672 shifts a data signal D based on the clock signal CK. An output of each flip-flop of the SR 672 is input to each scan electrode driver circuit.

The scan driver 16 includes a scan pattern decoder circuit 674. The scan pattern decoder circuit 674 is a decoder circuit for outputting either the voltage level V3 or MV3 based on the field signals f1 to f4 corresponding to four states indicated by the 2-bit field setting signals F1 and F2 and the polarity inversion signal FR. The scan pattern decoder circuit 674 decodes the scan pattern corresponding to the scan pattern shown in FIG. 10.

In FIG. 19, the latch pulse LP is a signal which specifies a vertical scanning period. A display OFF signal XDOFFC is equivalent to the display OFF signal XDOFF shown in FIG. 6. The display OFF signal XDOFFC sets the entire liquid crystal panel in the liquid crystal display-OFF-state in the scan driver 16. A shoot signal SHO is an output signal of a register which specifies whether or not to drive the scan electrodes in each scan electrode driver circuit corresponding to the simultaneously selected three scan electrodes. For example, either the voltage level V3 or MV3 is output to the scan electrodes which are set to be driven by the shoot signal SHO in the selected period by the output signal of the SR 672. The center voltage level VC is output to the scan electrodes which are set to be not driven by the shoot signal SHO by masking the output signal of the SR 672 even in the selected period.

Figure 20:
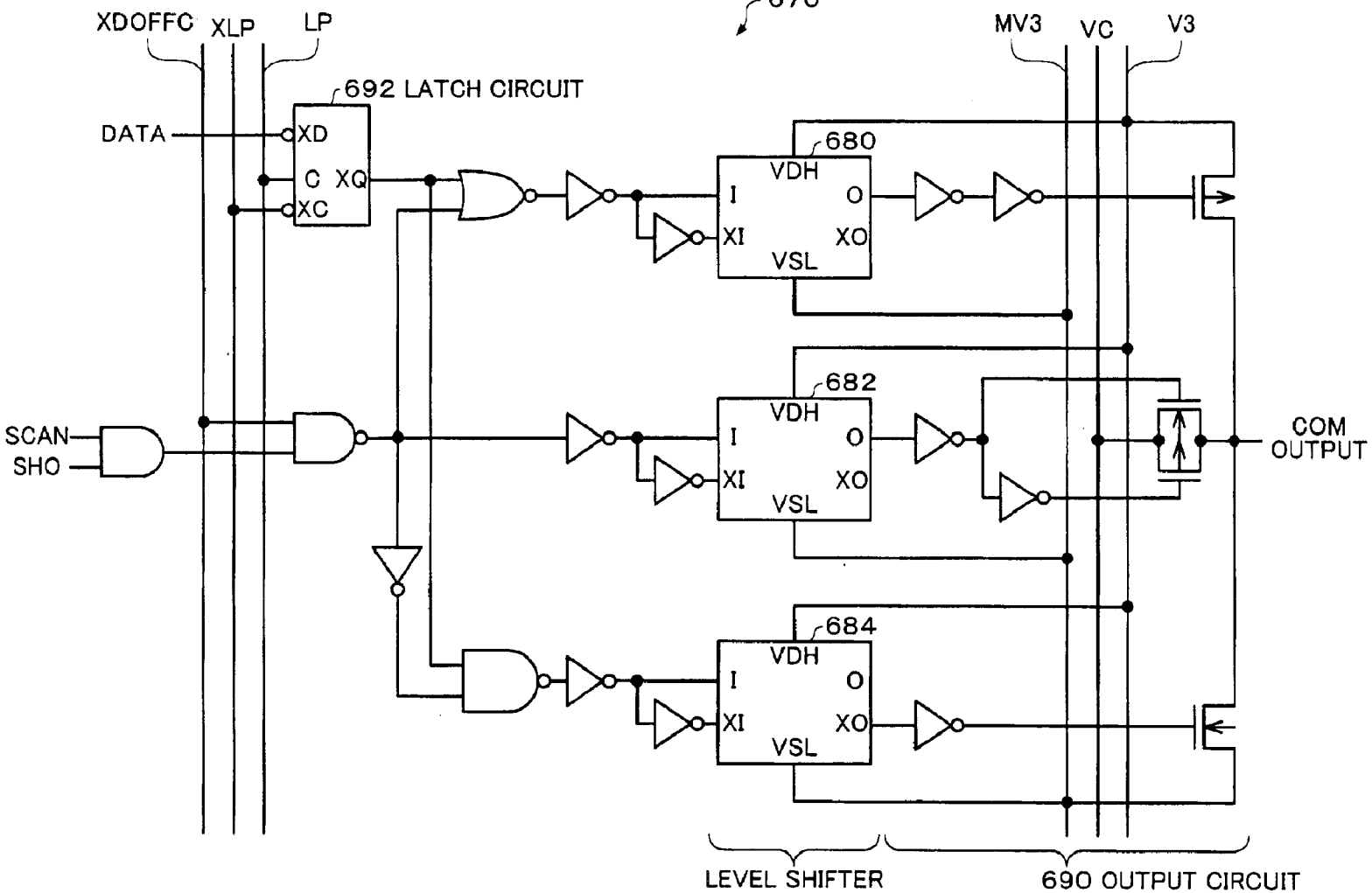
FIG. 20 is a circuit configuration diagram showing a detailed circuit configuration example of a scan electrode driver circuit.

FIG. 20 shows a detailed circuit configuration example of the scan electrode driver circuit.

FIG. 20 shows a configuration example of the circuit per scan electrode.

The data signal DATA is the output signal of the scan pattern decoder circuit 674. A scan signal SCAN is an output signal of the SR 672.

The scan electrode driver circuit 670 includes level shifters 680, 682, and 684 for each COM output. The level shifter 680 is a level conversion circuit for outputting the voltage level V3 to the scan electrode. The level shifter 682 is a level conversion circuit for outputting the center voltage level VC to the scan electrode. The level shifter 684 is a level conversion circuit for outputting the voltage level MV3 to the scan electrode. Each level shifter level shifts the difference in voltage between signals input to an I terminal and an XI terminal and outputs the signals to an O terminal and an XO terminal. An output circuit 690 outputs one of the voltage levels V3, VC, and MV3 to the scan electrode based on the output signals of the level shifters 680, 682, and 684. Each transistor which makes up the level shifters 680, 682, and 684 and the output circuit 690 is a high withstand voltage transistor which operates even at the difference between the voltage levels V3 and MV3.

The scan electrode driver circuit 670 drives the scan electrodes at either the voltage level V3 or MV3 when both the scan signal SCAN and the shoot signal SHO are at a logic level "H". The scan electrode driver circuit 670 drives the scan electrodes at the voltage level VC when one of the scan signal SCAN and the shoot signal SHO is at a logic level "L".

In FIG. 20, the voltage levels V3 and MV3 are output in the selected period shown in FIG. 6 when the logic level of the display OFF signal XDOFFC is "H". The voltage level VC is output even in the selected period when the logic level of the display OFF signal XDOFFC is "L" or the logic level of the display OFF signal XDOFFC is "H", as shown in FIG. 6.

In this embodiment, in the case where the signal driver does not have a voltage level shared between the signal driver and the scan driver which drives the liquid crystal panel, such as in the case where the number of voltage levels necessary for driving the signal electrode is an even number (the number of voltage levels necessary for driving the signal electrode is two in 3MLS by employing the concept of the virtual electrode), the signal driver changes the voltage level output to the signal electrode to the voltage level (center voltage level VC, for example) of the scan driver. This eliminates the need to provide a circuit which generates a voltage level shared between the signal driver and the scan driver to the signal driver. In the case of performing polarity inversion drive, the above change control is performed based on the polarity inversion timing after a period in which the voltages having different polarities are alternately output in the polarity inversion cycle. Therefore, a DC component is not applied to the liquid crystal element when performing display-OFF-control or display-ON-control, whereby deterioration of the liquid crystal can be prevented.

The present invention is not limited to the above embodiments. Various modifications and variations are possible within the scope of the present invention.

As electronic equipment to which the above electro-optical device is applied, equipment for which a decrease in power consumption is strongly demanded such as a pager, watch, and a personal data assistant (PDA) is suitable in addition to the above-described portable telephone. Moreover, the electro-optical device can also be applied to a liquid crystal TV, view finder type or direct-view monitor type video tape recorder, car navigation system, calculator, word processor, work station, videophone, POS terminal, equipment provided with a touch panel, and the like.

3MLS is described in this embodiment. However, the present invention is not limited by the number of simultaneously selected lines.

This embodiment is described taking four bits of grayscale data as an example. However, the present invention is not limited by the number of bits of grayscale data.

What is claimed is:

1. A display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-OFF-control which shifts a pixel specified by one of the scan electrodes and one of the signal electrodes from a display-ON-state to a display-OFF-state, the selector circuit changes the selected voltage from the first voltage to the fixed voltage and outputs the selected voltage, and the multi-valued voltage select circuit fixedly selects the selected voltage after the selected voltage is changed to the fixed voltage by the selector circuit.

2. The display driver circuit according to claim 1, wherein, when the selected voltage is changed to the fixed voltage by the selector circuit, the multi-valued voltage select circuit selects one of the selected voltage and a second voltage from among a plurality of voltages including the selected voltage as the output voltage, and the selector circuit changes the selected voltage from the first voltage to the fixed voltage, when the second voltage is selected by the multi-valued voltage select circuit.

3. A display driver circuit which drives a plurality of signal electrodes of a display panel having a plurality of scan electrodes and the signal electrodes, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects an output voltage from among a plurality of voltages including the selected voltage based on at least a polarity inversion signal, and a signal electrode driver circuit which drives the signal electrodes based on the output voltage, wherein, when performing display-ON-control which shifts a pixel specified by one of the scan electrodes and one of the signal electrodes from a display-OFF-state to a display-ON-state, the selector circuit changes the selected voltage from the fixed voltage to the first voltage and outputs the selected voltage, and the multi-valued voltage select circuit fixedly selects the selected voltage until the selected voltage is changed to the first voltage by the selector circuit.

4. The display driver circuit according to claim 3, wherein, when the selected voltage is changed to the first voltage by the selector circuit, the multi-valued voltage select circuit selects one of the selected voltage and a second voltage from among a plurality of voltages including the selected voltage as the output voltage, and the selector circuit changes the selected voltage from the first voltage to the fixed voltage, when the second voltage is selected by the multi-valued voltage select circuit.

5. The display driver circuit according to claim 2, wherein the first voltage and the second voltage have the smallest absolute value of voltage level based on the fixed voltage among the plurality of voltages, the first and the second voltage having inversed polarities.

6. The display driver circuit according to claim 4, wherein the first voltage and the second voltage have the smallest absolute value of voltage level based on the fixed voltage among the plurality of voltages, the first and the second voltage having inversed polarities.

7. The display driver circuit according to claim 1, wherein the fixed voltage is a voltage supplied to one of the scan electrodes in a nonselected period of the pixel.

8. The display driver circuit according to claim 2, wherein the fixed voltage is a voltage supplied to one of the scan electrodes in a nonselected period of the pixel.

9. The display driver circuit according to claim 3, wherein the fixed voltage is a voltage supplied to one of the scan electrodes in a nonselected period of the pixel.

10. The display driver circuit according to claim 4, wherein the fixed voltage is a voltage supplied to one of the scan electrodes in a nonselected period of the pixel.

11. The display driver circuit according to claim 5, wherein the fixed voltage is a voltage supplied to one of the scan electrodes in a nonselected period of the pixel.

12. The display driver circuit according to claim 6, wherein the fixed voltage is a voltage supplied to one of the scan electrodes in a nonselected period of the pixel.

13. A display driver circuit which drives a plurality of signal electrodes of a display panel having a plurality of scan electrodes and the signal electrodes by using a multi-line selection which selects three lines of the scan electrodes simultaneously, the scan electrodes and the signal electrodes intersecting each other, comprising:

a selector circuit which outputs one of a first voltage and a given fixed voltage, which is supplied to one of the scan electrodes, as a selected voltage, a multi-valued voltage select circuit which selects one of the selected voltage and a second voltage as an output voltage based on at least a polarity inversion signal, a signal electrode driver circuit which drives the signal electrodes based on the output voltage, and a power supply circuit which generates the fixed voltage, the first and second voltages, and third and fourth voltages applied to one of the scan electrodes, wherein the selector circuit outputs the fixed voltage when performing display-OFF-control which shifts a pixel specified by one of the scan electrodes and one of the signal electrodes from a display-ON-state to a display-OFF-state, and outputs the first voltage when performing display-ON-control which shifts the pixel from the display-OFF-state to the display-ON-state, wherein the multi-valued voltage select circuit fixedly selects the selected voltage after the selected voltage is changed to the fixed voltage by the selector circuit when performing the display-OFF-control, and fixedly selects the selected voltage until the selected voltage is changed to the first voltage by the selector circuit when performing the display-ON-control, wherein the third and fourth voltages are output to one of the scan electrodes connected with the pixel in a selected period of the pixel, and wherein the fixed voltage is output to one of the scan electrodes connected with the pixel in a nonselected period of the pixel and a period in which one of the display-OFF-control and the display-ON-control of the pixel is performed.

14. An electro-optical device comprising:

a plurality of scan electrodes, a plurality of signal electrodes, the display driver circuit according to claim 1 which drives the signal electrodes, and a scan driver which drives the scan electrodes.

15. An electro-optical device comprising:

a plurality of scan electrodes, a plurality of signal electrodes, the display driver circuit according to claim 2 which drives the signal electrodes, and a scan driver which drives the scan electrodes.

16. An electro-optical device comprising:

a plurality of scan electrodes, a plurality of signal electrodes, the display driver circuit according to claim 3 which drives the signal electrodes, and a scan driver which drives the scan electrodes.

17. An electro-optical device comprising:

a plurality of scan electrodes, a plurality of signal electrodes, the display driver circuit according to claim 4 which drives the signal electrodes, and a scan driver which drives the scan electrodes.

18. An electro-optical device comprising:

a plurality of scan electrodes, a plurality of signal electrodes, the display driver circuit according to claim 13 which drives the signal electrodes, and a scan driver which drives the scan electrodes.

19. A display drive method of performing display-OFF-control which shifts a pixel of a display panel having a plurality of scan electrodes and a plurality of signal electrodes from a display-ON-state to a display-OFF-state, the scan electrodes and the signal electrodes intersecting each other, the method comprising:

supplying a voltage selected from among a plurality of voltages to one of the signal electrodes based on grayscale data and a polarity inversion signal, fixing an output voltage to one of the scan electrodes at a given fixed voltage, selecting a first voltage and a second voltage having different polarities from among the plurality of voltages, and alternately supplying the first voltage and the second voltage to one of the signal electrodes based on the polarity inversion signal, setting the first voltage at the fixed voltage when the second voltage is selected based on the polarity inversion signal, and supplying the first voltage set at the fixed voltage to one of the signal electrodes.

20. A display drive method of performing display-ON-control which shifts a pixel of a display panel having a plurality of scan electrodes and a plurality of signal electrodes from a display-OFF-state to a display-ON-state, the scan electrodes and the signal electrodes intersecting each other, the method comprising:

supplying a first voltage set at a given fixed voltage to one of the signal electrodes, while fixing an output voltage to one of the scan electrodes at the fixed voltage, selecting a second voltage having a polarity different from the polarity of the first voltage, and setting the first voltage at a voltage different from the fixed voltage, alternately supplying the first voltage set at the voltage different from the fixed voltage, and the second voltage to one of the signal electrodes based on a polarity inversion signal, and supplying a voltage selected from among a plurality of voltages based on grayscale data and the polarity inversion signal to one of the signal electrodes.

21. The display drive method according to claim 19, wherein the fixed voltage is a voltage supplied to one of the scan electrodes in a nonselected period of the pixel specified by one of the scan electrodes and one of the signal electrodes.

22. The display drive method according to claim 20, wherein the fixed voltage is a voltage supplied to one of the scan electrodes in a nonselected period of the pixel specified by one of the scan electrodes and one of the signal electrodes.

* * * * *